US011629557B2

(12) United States Patent
Marchand et al.

(10) Patent No.: US 11,629,557 B2
(45) Date of Patent: Apr. 18, 2023

(54) HYBRID BEARING ASSEMBLIES FOR DOWNHOLE MOTORS

(71) Applicant: National Oilwell DHT, L.P., Houston, TX (US)

(72) Inventors: Nicholas Ryan Marchand, Edmonton (CA); Jeffery Ronald Clausen, Tulsa, OK (US)

(73) Assignee: National Oilwell Varco, L.P., Houston, TX (US)

( * ) Notice: Subject to any disclaimer, the term of this patent is extended or adjusted under 35 U.S.C. 154(b) by 610 days.

(21) Appl. No.: 16/398,158

(22) Filed: Apr. 29, 2019

(65) Prior Publication Data

US 2019/0330925 A1 Oct. 31, 2019

Related U.S. Application Data

(60) Provisional application No. 62/663,691, filed on Apr. 27, 2018.

(51) Int. Cl.
*E21B 4/00* (2006.01)
*E21B 7/06* (2006.01)
(Continued)

(52) U.S. Cl.
CPC ..... *E21B 7/068* (2013.01); *E21B 4/003* (2013.01); *E21B 7/067* (2013.01); *E21B 21/08* (2013.01); *E21B 21/103* (2013.01); *E21B 4/02* (2013.01)

(58) Field of Classification Search
CPC ..... E21B 4/003; E21B 7/067; E21B 7/068; E21B 21/08
See application file for complete search history.

(56) References Cited

U.S. PATENT DOCUMENTS

2007/0235227 A1* 10/2007 Kirkhope ..... E21B 7/068 175/73
2010/0326730 A1* 12/2010 Prill ..... E21B 4/003 175/57

(Continued)

FOREIGN PATENT DOCUMENTS

WO 2017027983 A1 2/2017

OTHER PUBLICATIONS

International Search Report and Written Opinion dated Jul. 15, 2019, for Application No. PCT/US2019/029754.

(Continued)

*Primary Examiner* — Christopher J Sebesta
*Assistant Examiner* — Lamia Quaim
(74) *Attorney, Agent, or Firm* — Conley Rose, P.C.

(57) ABSTRACT

A downhole motor includes a driveshaft assembly including a driveshaft housing and a driveshaft rotatably disposed within the driveshaft housing, and a bearing assembly including a bearing housing and a bearing mandrel rotatably disposed within the bearing housing, wherein the bearing mandrel is configured to couple with a drill bit, wherein the bearing assembly is configured to provide a first flowpath extending into a central passage of the bearing mandrel from an annulus formed between the bearing mandrel and the bearing housing and a second flowpath separate from the first flowpath, that extends through a bearing of the bearing assembly that is disposed radially between the bearing mandrel and the bearing housing, wherein a plurality of rotary seals are positioned radially between the bearing mandrel and the bearing housing to form an sealed chamber that is spaced from the bearing of the bearing assembly.

30 Claims, 27 Drawing Sheets

(51) Int. Cl.

| | |
|---|---|
| ***E21B 21/08*** | (2006.01) |
| ***E21B 21/10*** | (2006.01) |
| *E21B 4/02* | (2006.01) |

(56) References Cited

U.S. PATENT DOCUMENTS

| | | | | |
|---|---|---|---|---|
| 2013/0051716 | A1 | 2/2013 | Cioceanu | |
| 2014/0037232 | A1* | 2/2014 | Marchand | E21B 4/003 384/91 |
| 2015/0034311 | A1* | 2/2015 | Tunget | E21B 47/12 166/250.14 |
| 2015/0345548 | A1* | 12/2015 | Peterson | F16C 17/10 384/282 |
| 2016/0237749 | A1* | 8/2016 | Marchand | E21B 4/02 |
| 2017/0089142 | A1 | 3/2017 | Schaaf et al. | |
| 2018/0045003 | A1* | 2/2018 | Evans | E21B 4/02 |
| 2018/0363380 | A1 | 12/2018 | Clausen et al. | |

OTHER PUBLICATIONS

Extended European Search Report dated Dec. 7, 2021, for Application No. EP 19791783.4.
Saudi First Examination Report dated Jan. 13, 2022, for Application No. SA 520420428.
Canadian Office Action dated Feb. 1, 2022, for Application No. 3,098,474 (11 p.).

* cited by examiner

HYBRID BEARING ASSEMBLIES FOR DOWNHOLE MOTORS

CROSS-REFERENCE TO RELATED APPLICATIONS

This application claims benefit of U.S. provisional patent application Ser. No. 62/663,691 filed Apr. 27, 2018, and entitled "Bearing Assemblies for Downhole Motors," which is hereby incorporated herein by reference in its entirety.

STATEMENT REGARDING FEDERALLY SPONSORED RESEARCH OR DEVELOPMENT

Not applicable.

BACKGROUND

It has become increasingly common in the oil and gas industry to use "directional drilling" techniques to drill horizontal and other non-vertical wellbores, to facilitate more efficient access to and production from larger regions of subsurface hydrocarbon-bearing formations than would be possible using only vertical wellbores. In directional drilling, specialized drill string components and "bottom-hole assemblies" (BHAs) are used to induce, monitor, and control deviations in the path of the drill bit, so as to produce a wellbore of desired non-vertical configuration.

Directional drilling is typically carried out using a "downhole motor" (alternatively referred to as a "mud motor") incorporated into the drill string immediately above the drill bit. A typical mud motor generally includes a top sub adapted to facilitate connection to the lower end of a drill string, a power section comprising a positive displacement motor of well-known type with a helically-vaned rotor eccentrically rotatable within a stator section, a drive shaft enclosed within a drive shaft housing, with the upper end of the drive shaft being operably connected to the rotor of the power section, and a bearing section comprising a cylindrical mandrel coaxially and rotatably disposed within a cylindrical housing, with an upper end coupled to the lower end of the drive shaft, and a lower end adapted for connection to a drill bit. The mandrel is rotated by the drive shaft, which rotates in response to the flow of drilling fluid under pressure through the power section, while the mandrel rotates relative to the cylindrical housing, which is connected to the drill string. Directional drilling allows the well to be drilled out at an angle. A bent housing motor is used to form a curved well path. The bent housing is often located above the bearing section and below the power section.

The bearing section of the downhole motor permits relative rotation between the bearing mandrel and the housing, while also transferring axial thrust loads between the bearing mandrel and the housing. Downhole motor bearing assemblies generally comprise either oil-sealed or mud-lubricated assemblies. Oil-sealed bearing assemblies typically utilize rotary seals positioned between the bearing mandrel and the housing, where the thrust and radial bearings of the oil-sealed bearing assembly is encased in an oil bath, often with a balancing or floating piston to compensate for thermal expansion and oil-volume loss from rotary seal seepage. In some applications, oil-sealed bearing assemblies may have lower wear and a higher service life than mud-lubricated bearing assemblies. However, oil-sealed bearing assemblies may require hard-surface coatings that increase the costs of manufacturing the oil-sealed bearing assembly. Additionally, due to the harsh nature of downhole conditions, the rotary seals of the oil-sealed bearing assembly can experience wear and occasional failure, leading to mud invasion of the bearing chamber of the oil-sealed bearing assembly and high wear and/or failure of the components of the oil-sealed bearing assembly. Also, drilling practices such as back reaming can cause severe loading which may lead to damage or failure of the thrust bearings of the oil-sealed bearing assembly.

Mud-lubricated bearing assemblies generally do not employ rotary seals, and instead, divert a portion of the drilling fluid to provide cooling flow to the bearings of the mud-lubricated bearing assembly. Thus, mud-lubricated bearing assemblies generally divert a portion of the flow of drilling fluid through the bearings to the annulus of the bearing assembly, thereby bypassing the drill bit. The amount of cooling flow through the mud-lubricated bearing assembly may be regulated by flow restrictors comprising a plurality of cylindrical sleeves having a small amount of clearance to allow some of the mud to escape through to the annulus formed therebetween. In some applications, mud-lubricated bearing assemblies may be less expensive than oil-sealed bearing assemblies. Additionally, mud-lubricated bearing assemblies comprising ball-bearing stacks may be more robust than conventional compact oil-sealed bearing assemblies employing roller thrust bearings, and may be more durable when exposed to handle harsh downhole conditions (vibration, back-reaming, etc.). However since the bearing elements of the mud-lubricated bearing assembly are typically exposed to the drilling fluid, wear of the bearing elements may be relatively greater and the service life of the bearings lower compared to oil-sealed bearing assemblies. Additionally, the flow restrictors of the mud-lubricated bearing assembly, which may serve as radial bearings, can experience a high amount of wear through the run, opening up the clearance gap of the flow restrictors and allowing an excessive amount of drilling fluid to bypass the drill bit.

BRIEF SUMMARY OF THE DISCLOSURE

An embodiment of a downhole motor for directional drilling comprises a driveshaft assembly including a driveshaft housing and a driveshaft rotatably disposed within the driveshaft housing, and a bearing assembly including a bearing housing and a bearing mandrel rotatably disposed within the bearing housing, wherein the bearing mandrel is configured to couple with a drill bit, wherein the bearing assembly is configured to provide a first flowpath extending into a central passage of the bearing mandrel from an annulus formed between the bearing mandrel and the bearing housing and a second flowpath separate from the first flowpath, that extends through a bearing of the bearing assembly that is disposed radially between the bearing mandrel and the bearing housing, wherein a plurality of rotary seals are positioned radially between the bearing mandrel and the bearing housing to form an sealed chamber that is spaced from the bearing of the bearing assembly. In some embodiments, the bearing comprises a ball bearing. In some embodiments, the bearing comprises a thrust bearing. In certain embodiments, the downhole motor further comprises a flow restrictor positioned radially between the bearing mandrel and the bearing housing, wherein the flow restrictor is configured to restrict fluid flow through the second flowpath. In certain embodiments, the downhole motor further comprises a bend assembly configured to permit selective adjustment of a bend formed between a central axis of the driveshaft housing and a central axis of the bearing housing. In some embodiments, the second flowpath re-enters the first flowpath before passing through the drill bit. In some embodiments, the sealed chamber comprises radial bushings. In certain embodiments, the sealed chamber comprises a hard-faced flow restrictor sleeve. In certain embodiments, the sealed chamber comprises polycrystalline diamond compact (PDC) radial bearings. In some embodiments, the downhole motor further comprises a flow control mechanism configured to regulate at least one of a fluid pressure and a fluid flowrate along the second flowpath. In some embodiments, the flow control mechanism is mechanically or hydraulically biased to control the fluid pressure or the fluid flowrate through the second flowpath. In certain embodiments, the downhole motor further comprises a port formed in the bearing mandrel comprising a nozzle configured to regulate the pressure or flowrate through the second flowpath. In certain embodiments, the downhole motor further comprises a bend adjustment assembly including a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle, and an actuator assembly positioned in the sealed chamber configured to shift the bend adjustment assembly between the first position and the second position. In some embodiments, the actuator assembly comprises an actuator housing through which the bearing mandrel extends, an actuator piston coupled to the actuator housing, wherein the actuator piston comprises a first plurality of teeth, and a teeth ring coupled to the bearing mandrel and comprising a second plurality of teeth, wherein the actuator piston is configured to matingly engage the first plurality of teeth with the second plurality of teeth of the teeth ring to transfer torque between the actuator housing and the bearing mandrel in response to the change in at least one of flowrate and pressure of the drilling fluid supplied to the downhole mud motor.

An embodiment of a downhole motor for directional drilling comprises a driveshaft housing, a driveshaft rotatably disposed in the driveshaft housing, a bearing mandrel coupled to the driveshaft, a bend adjustment assembly including a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel that is different from the first deflection angle, and a locking assembly comprising a locked configuration configured to lock the bend adjustment assembly in at least one of the first position and the second position and an unlocked configuration configured to permit an actuator assembly to shift the bend adjustment assembly between the first position and the second position. In some embodiments, the actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel. In certain embodiments, the downhole motor further comprises an offset housing comprising a first longitudinal axis and a first offset engagement surface concentric to a second longitudinal axis that is offset from the first longitudinal axis, and an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface, wherein the locking assembly comprises a plurality of circumferentially spaced protrusions extending from the offset housing and a plurality of circumferentially spaced protrusions extending from the adjustment mandrel and configured to interlock with the protrusions of the offset housing when the locking assembly is in the locked configuration. In certain embodiments, the locking assembly further comprises a selector pin configured to retain the locking assembly in the unlocked configuration. In some embodiments, the downhole motor further comprises a shear pin configured to retain the locking assembly in the locked configuration. In some embodiments, the bearing assembly is configured to provide a first flowpath extending into a central passage of the bearing mandrel from an annulus formed between the bearing mandrel and the bearing housing and a second flowpath separate from the first flowpath, that extends through a bearing of the bearing assembly that is disposed radially between the bearing mandrel and the bearing housing, and a plurality of rotary seals are positioned radially between the bearing mandrel and the bearing housing to form an sealed chamber that is spaced from the bearing of the bearing assembly.

An embodiment of a downhole motor for directional drilling comprises a driveshaft housing, a driveshaft rotatably disposed in the driveshaft housing, a bearing mandrel coupled to the driveshaft, a bend adjustment assembly including a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel that is different from the first deflection angle, an actuator assembly configured to shift the bend adjustment assembly between the first position and the second position, a locking piston comprising a locked position configured to prevent the actuator assembly from shifting the bend adjustment assembly between the first and second positions, and an unlocked position configured to permit the actuator assembly to shift the bend adjustment assembly between the first and second positions, a fluid metering assembly configured to restrict fluid flow to delay the actuation of the locking piston from the locked position to the unlocked position. In some embodiments, the locking piston is configured to actuate from the locked position to the unlocked position in response to fluid flow through a locking chamber of the bend adjustment assembly, and the fluid metering assembly is configured to restrict fluid flow through the locking chamber. In some embodiments, the actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel. In certain embodiments, the downhole motor further comprises an offset housing comprising a first longitudinal axis and a first offset engagement surface concentric to a second longitudinal axis that is offset from the first longitudinal axis, and an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface, and wherein the locked position of the locking piston restricts relative rotation between the offset housing and the adjustment mandrel, and the unlocked position, axially spaced from the locked position, of the locking piston permits relative rotation between the offset housing and the adjustment mandrel. In certain embodiments, the fluid metering assembly comprises an annular seal carrier and an annular seal body positioned around the locking piston. In some embodiments, an endface of the seal carrier is configured to sealingly engage an endface of the seal body when the locking piston actuates from the locked position to the unlocked position. In some embodiments, the endface of the seal carrier comprises a metering slot. In certain embodiments, the fluid metering device comprises at least one of a fluid restrictor and a check valve positioned in a passage extending through the offset housing. In certain embodiments, the bearing assembly is configured to provide a first flowpath extending into a central passage of the bearing mandrel from an annulus formed between the bearing mandrel and the bearing housing and a second flowpath separate from the first flowpath, that extends through a bearing of the bearing assembly that is disposed radially between the bearing mandrel and the bearing housing, and a plurality of rotary seals are positioned radially between the bearing mandrel and the bearing housing to form an sealed chamber that is spaced from the bearing of the bearing assembly.

BRIEF DESCRIPTION OF THE DRAWINGS

For a detailed description of exemplary embodiments of the disclosure, reference will now be made to the accompanying drawings in which.

DETAILED DESCRIPTION

Figure 1:
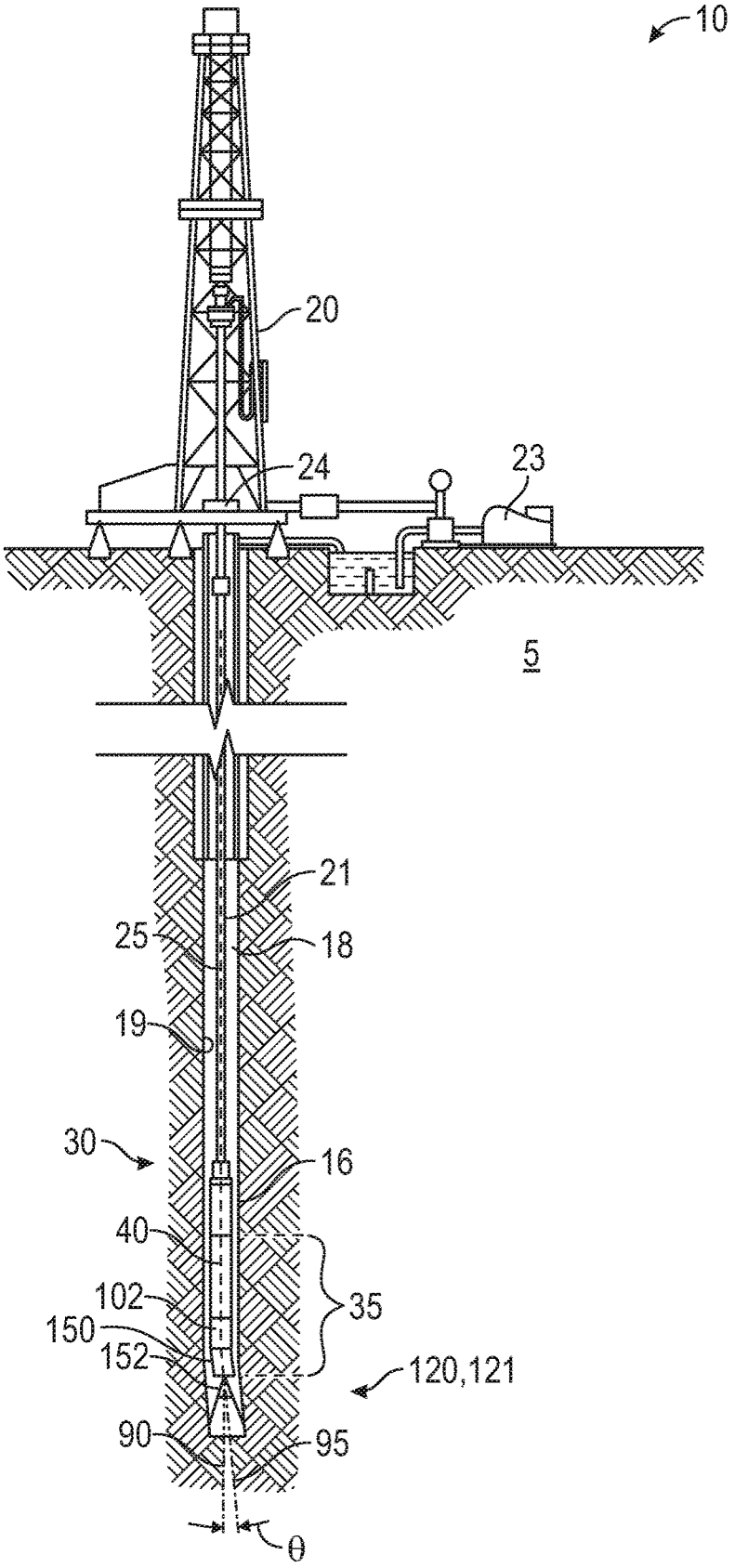
FIG. 1 is a schematic partial cross-sectional view of a drilling system including an embodiment of a downhole mud motor in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring to FIG. 1, an embodiment of a well system 10 is shown. Well system 10 is generally configured for drilling a borehole 16 in an earthen formation 5. In the embodiment of FIG. 1, well system 10 includes a drilling rig 20 disposed at the surface, a drillstring 21 extending downhole from rig 20, a bottomhole assembly (BHA) 30 coupled to the lower end of drillstring 21, and a drill bit 90 attached to the lower end of BHA 30. A surface or mud pump 23 is positioned at the surface and pumps drilling fluid or mud through drillstring 21. Additionally, rig 20 includes a rotary system 24 for imparting torque to an upper end of drillstring 21 to thereby rotate drillstring 21 in borehole 16. In this embodiment, rotary system 24 comprises a rotary table located at a rig floor of rig 20; however, in other embodiments, rotary system 24 may comprise other systems for imparting rotary motion to drillstring 21, such as a top drive. A downhole mud motor 35 is provided in BHA 30 for facilitating the drilling of deviated portions of borehole 16. Moving downward along BHA 30, motor 35 includes a hydraulic drive or power section 40, a driveshaft assembly 102, and a bearing assembly 150. In some embodiments, the portion of BHA 30 disposed between drillstring 21 and motor 35 can include other components, such as drill collars, measurement-while-drilling (MWD) tools, reamers, stabilizers and the like.

Power section 40 of BHA 30 converts the fluid pressure of the drilling fluid pumped downward through drillstring 21 into rotational torque for driving the rotation of drill bit 90. Driveshaft assembly 102, a bend assembly 120, and a bearing assembly 150 transfer the torque generated in power section 40 to bit 90. With force or weight applied to the drill bit 90, also referred to as weight-on-bit ("WOB"), the rotating drill bit 90 engages the earthen formation and proceeds to form borehole 16 along a predetermined path toward a target zone. The drilling fluid or mud pumped down the drillstring 21 and through BHA 30 passes out of the face of drill bit 90 and back up the annulus 18 formed between drillstring 21 and the wall 19 of borehole 16. The drilling fluid cools the bit 90, and flushes the cuttings away from the face of bit 90 and carries the cuttings to the surface.

Figure 2:
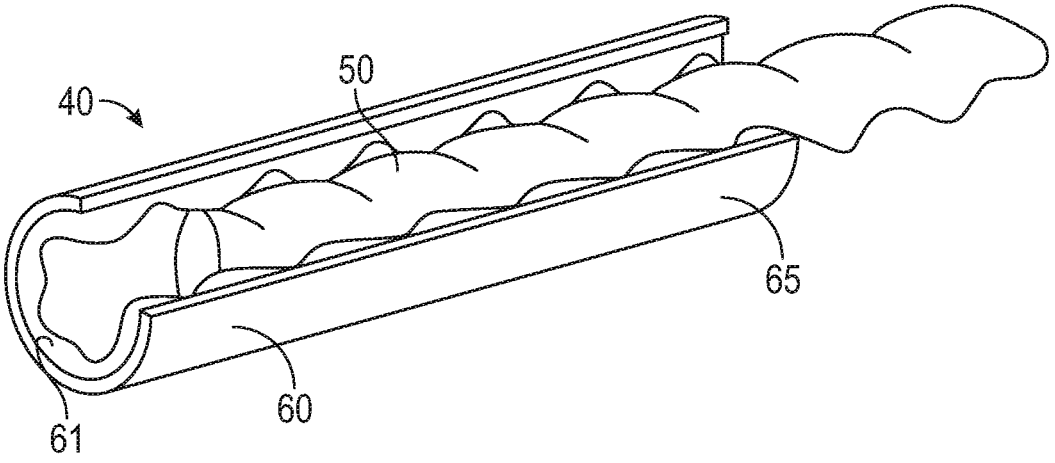
FIG. 2 is a perspective, partial cut-away view of the power section of FIG. 1.
Figure 3:
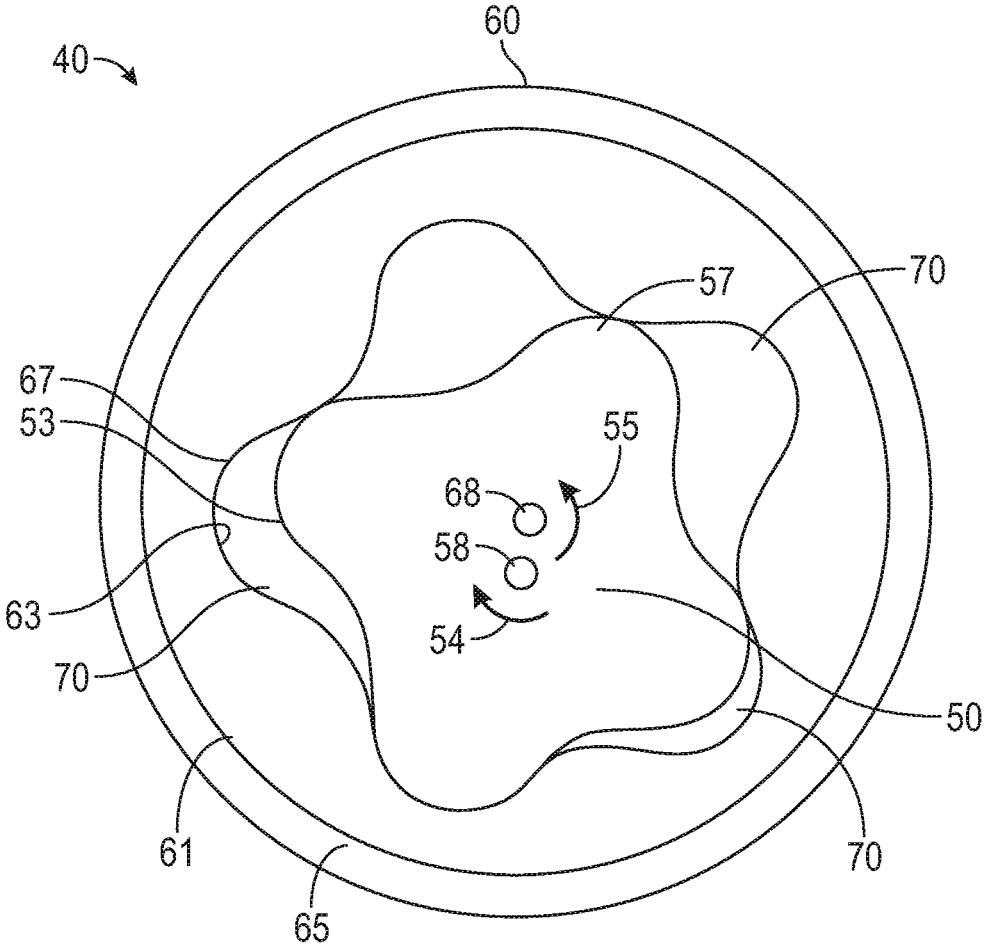
FIG. 3 is a cross-sectional end view of the power section of FIG. 1.

Referring to FIGS. 1-3, an embodiment of the power section 40 of BHA 30 is shown schematically in FIGS. 2 and 3. In the embodiment of FIGS. 2 and 3, power section 40 comprises a helical-shaped rotor 50 disposed within a stator 60 comprising a cylindrical stator housing 65 lined with a helical-shaped elastomeric insert 61. Helical-shaped rotor 50 defines a set of rotor lobes 57 that intermesh with a set of stator lobes 67 defined by the helical-shaped insert 61. As best shown in FIG. 3, the rotor 50 has one fewer lobe 57 than the stator 60. When the rotor 50 and the stator 60 are assembled, a series of cavities 70 are formed between the outer surface 53 of the rotor 50 and the inner surface 63 of the stator 60. Each cavity 70 is sealed from adjacent cavities 70 by seals formed along the contact lines between the rotor 50 and the stator 60. The central axis 58 of the rotor 50 is radially offset from the central axis 68 of the stator 60 by a fixed value known as the "eccentricity" of the rotor-stator assembly. Consequently, rotor 50 may be described as rotating eccentrically within stator 60.

During operation of the hydraulic drive section 40, fluid is pumped under pressure into one end of the hydraulic drive section 40 where it fills a first set of open cavities 70. A pressure differential across the adjacent cavities 70 forces the rotor 50 to rotate relative to the stator 60. As the rotor 50 rotates inside the stator 60, adjacent cavities 70 are opened and filled with fluid. As this rotation and filling process repeats in a continuous manner, the fluid flows progressively down the length of hydraulic drive section 40 and continues to drive the rotation of the rotor 50. Driveshaft assembly 102 shown in FIG. 1 includes a driveshaft discussed in more detail below that has an upper end coupled to the lower end of rotor 50. In this arrangement, the rotational motion and torque of rotor 50 is transferred to drill bit 90 via driveshaft assembly 102 and bearing assembly 150.

In the embodiment of FIGS. 1-3, driveshaft assembly 102 is coupled to bearing assembly 150 via bend assembly 120 of BHA 30 that provides an adjustable bend 121 along motor 35. Due to bend 121, a deflection or bend angle θ is formed between a central or longitudinal axis 95 (shown in FIG. 1) of drill bit 90 and the longitudinal axis 25 of drillstring 21. To drill a straight section of borehole 16, drillstring 21 is rotated from rig 20 with a rotary table or top drive to rotate BHA 30 and drill bit 90 coupled thereto. Drillstring 21 and BHA 30 rotate about the longitudinal axis of drillstring 21, and thus, drill bit 90 is also forced to rotate about the longitudinal axis of drillstring 21. With bit 90 disposed at bend angle θ, the lower end of drill bit 90 distal BHA 30 seeks to move in an arc about longitudinal axis 25 of drillstring 21 as it rotates, but is restricted by the sidewall 19 of borehole 16, thereby imposing bending moments and associated stress on BHA 30 and mud motor 35. In general, the magnitudes of such bending moments and associated stresses are directly related to the bit-to-bend distance D—the greater the bit-to-bend distance D, the greater the bending moments and stresses experienced by BHA 30 and mud motor 35.

In general, driveshaft assembly 102 functions to transfer torque from the eccentrically-rotating rotor 50 of power section 40 to a concentrically-rotating bearing mandrel 152 of bearing assembly 150 and drill bit 90. As best shown in FIG. 3, rotor 50 rotates about rotor axis 58 in the direction of arrow 54, and rotor axis 58 rotates about stator axis 68 in the direction of arrow 55. However, drill bit 90 and bearing mandrel 152 are coaxially aligned and rotate about a common axis that is offset and/or oriented at an acute angle relative to rotor axis 58. Thus, driveshaft assembly 102 converts the eccentric rotation of rotor 50 to the concentric rotation of bearing mandrel 152 and drill bit 90, which are radially offset and/or angularly skewed relative to rotor axis 58.

Figure 4:
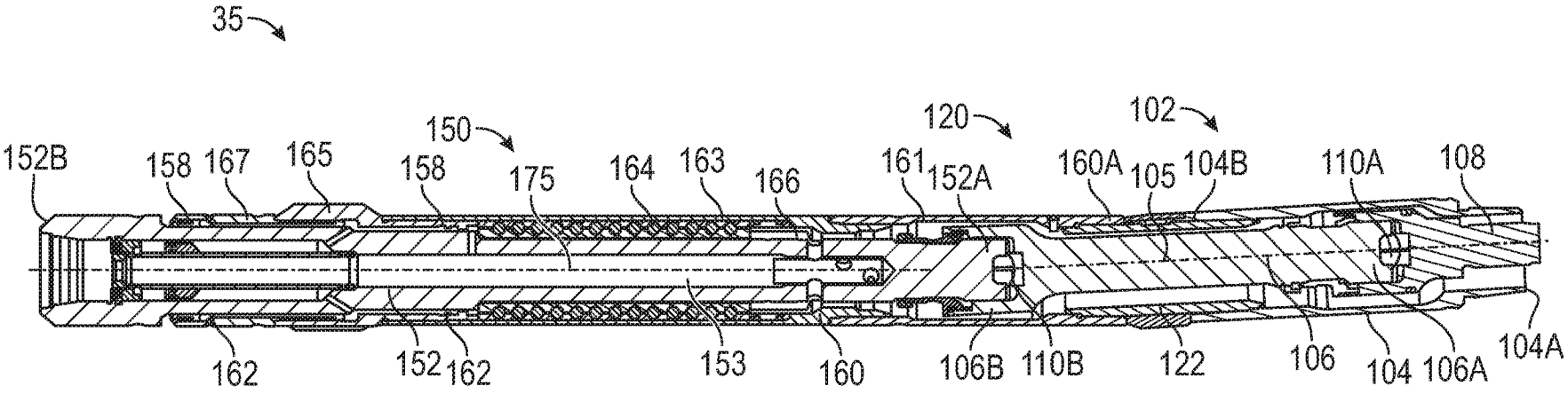
FIG. 4 is a side cross-sectional view of an embodiment of a downhole mud motor of the drilling system of FIG. 1 in accordance with principles disclosed herein.
Figure 5:
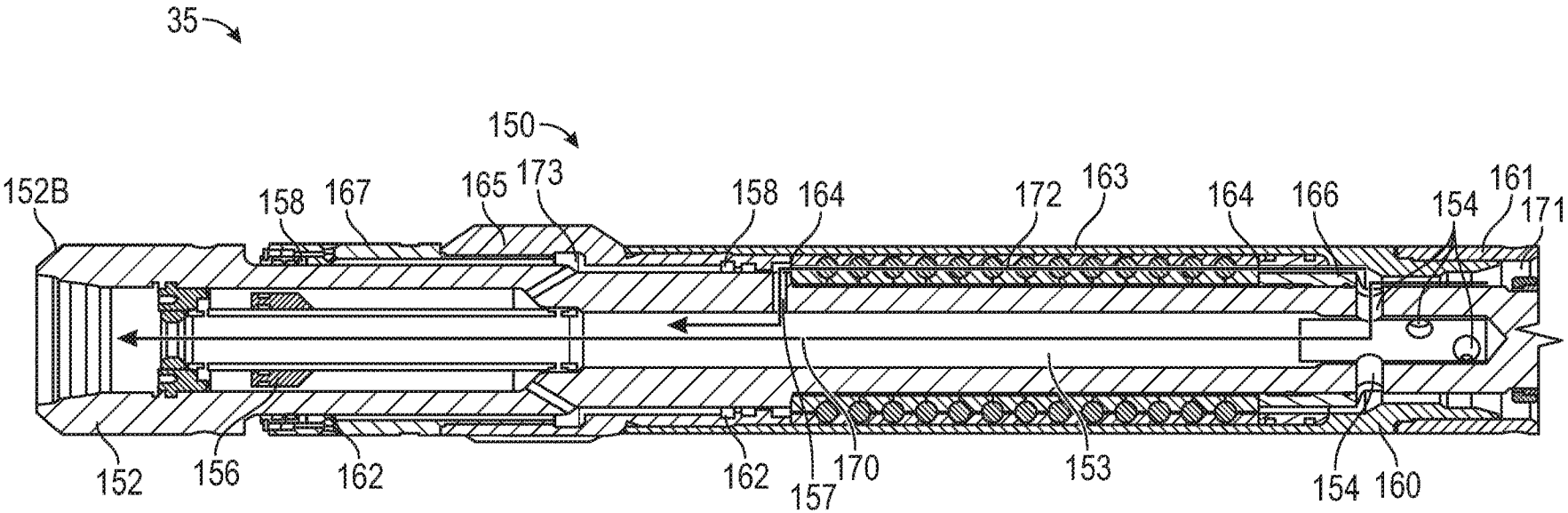
FIG. 5 is a side cross-sectional view of an embodiment of a bearing assembly of the mud motor of FIG. 4 in accordance with principles disclosed herein.

Referring to FIGS. 1, 4, an embodiment of mud motor 35 is shown in FIGS. 4, 5. In the embodiment of FIGS. 1, 4, and 5, mud motor 35 generally includes a driveshaft assembly 102, a bend assembly 120, and a bearing assembly 150. Driveshaft assembly 102 of mud motor 35 includes an outer or driveshaft housing 104 having a central or longitudinal axis 105 (shown in FIG. 4) and a one-piece (i.e., unitary) driveshaft 106 rotatably disposed within driveshaft housing 104. An externally threaded connector or pin end of driveshaft housing 104 located at a first or upper end 104A thereof threadably engages a mating internally threaded connector or box end disposed at the lower end of stator housing 65 of the stator shown in FIGS. 2, 3. Additionally, an internally threaded connector or box end of driveshaft housing 104 located at a second or lower end 104B thereof threadably engages a mating externally threaded connector of bend assembly 120.

An upper end 106A of driveshaft 106 is pivotally coupled to the lower end of the rotor 50 shown in FIGS. 2, 3 with a driveshaft adapter 108 and a first or upper universal joint 110A. Additionally, a lower end 106B of driveshaft 106 is pivotally coupled to a first or upper end 152A of the bearing mandrel 152 of bearing assembly 150 with a second or lower universal joint 110B. Universal joints 110A, 110B may be similar in configuration to the universal joints shown and described in U.S. Pat. Nos. 9,347,269 and 9,404,527, each of which are incorporated herein by reference in their entirety. Bearing mandrel 152 includes a second or lower end 152B opposite upper end 152A and configured to couple with bit 90. Additionally, bearing mandrel 152 includes a central bore or passage 153 extending between ends 152A, 152B. Central passage 153 of bearing mandrel 152 provides a conduit for drilling fluid supplied to bit 90.

In this embodiment, bend assembly 120 of mud motor 35 generally includes an adjustment housing 122 releasably or threadably coupled between the lower end 104B of driveshaft housing 104 of driveshaft assembly 102 and a first or upper end 160A of a bearing housing 160 of bearing assembly 150. In this embodiment, bearing housing 160 of mud motor 35 generally includes a first or upper housing 161, a second or intermediate housing 163, and a pair of lower housings 165, 167, each coupled together to form bearing housing 160; however, in other embodiments, the number of separate housings of bearing housing 160 may vary. Adjustment housing 122 is configured to allow for the selective adjustment of bend angle θ, where bend angle θ, in addition to being formed between the central axis 25 of drillstring 21 and the central axis 95 of bit 90, is also formed between a central axis 105 of driveshaft housing 104 and a central or longitudinal axis 175 (shown in FIG. 4) of bearing housing 160 of mud motor 35. In this embodiment, bearing assembly 150 of mud motor 35 generally includes bearing mandrel 152 rotatably disposed in bearing housing 160, annular seals 158 (e.g., rotary seals (Kalsi Seals®, etc.) or optional mechanical seals, etc.) disposed radially between bearing mandrel 152 and bearing housing 160, at least one annular radial support 162 (e.g., bushings and/or optional hard-faced sleeve bearings or flow restrictors), a ball bearing assembly or stack 164 disposed radially between bearing mandrel 152 and bearing housing 160, and an annular flow restrictor 166 also disposed radially between bearing mandrel 152 and bearing housing 160.

As shown particularly in FIG. 5, in this embodiment, bearing mandrel 152 of bearing assembly 150 includes a balancing piston 156 slidably disposed in central passage 153 of bearing mandrel 152, and a plurality of radial flow ports 154 extending between an outer cylindrical surface of bearing mandrel 152 and central passage 153. Balancing piston 156 may include features in common with the bearing mandrels and associated features disclosed in U.S. Pat. No. 9,683,409, which is incorporated herein by reference for all of its teachings. Radial flow ports 154 in bearing mandrel 152 permit a main fluid flowpath 170 to enter the passage of bearing mandrel 152 from an annulus 171 formed radially between the outer surface of bearing mandrel 152 and a cylindrical inner surface of bearing housing 160 while flow restrictor 166 permits a portion of the fluid flowing along main fluid flowpath 170 to be diverted along a bearing fluid flowpath 172 extending through ball bearing stack 164. Fluid flowing along bearing fluid flowpath 172 enters central passage 153 of bearing mandrel 152 via a lower radial port 157 disposed axially below ball bearing assembly 164. In this configuration, ball bearing assembly 164 is positioned axially between radial flow ports 154 and lower radial port 157 of bearing mandrel 152.

Annular seals 158 define an annular sealed oil chamber 173 extending therebetween. Balancing piston 156 is configured to provide pressure compensation or balancing between sealed oil chamber 173 and fluid flowing along main fluid flowpath 170, thereby equalizing pressure between fluid disposed in sealed oil chamber 173 and fluid flowing through central passage 153 of bearing mandrel 152. In this embodiment, annular seals 158 seal fully between the bearing mandrel 152 and bearing housing 160, ensuring substantially full flow of drilling fluid to bit 90 along main fluid flowpath 170. Radial supports 162 provide a substantial length of radial support near the bit box (e.g., lower end 152B of bearing mandrel 152), which, in at least some applications, is the location of the highest radial loading within bearing assembly 150 during drilling operations. Bearing assembly 150, equipped with radial supports 162, is configured to withstand relatively greater radial loads compared to conventional mud lube layouts using hard-faced flow restrictor sleeves.

In some embodiments, radial supports 162 comprise a combination of hard-faced flow restrictor sleeves, these sleeves could employ tungsten carbide coatings, diamond composite coatings, thermally stabile polycrystalline tiles or Polycrystaline Diamond Compact (PDC) inserts, positioned axially between a series of radial bushings. With annular seals 158 comprising radial seals (e.g., Kalsi Seals®, etc.) placed axially above and below the section of bearing assembly 150 including radial supports 162, potentially all of the fluid flowing along main fluid flowpath 170 could be directed to bit 90 without bypassing any fluid flow to annulus 18. In this configuration, a second level of protection is provided to allow the mud motor 35 to drill ahead and finish drilling borehole 16 even in the event of failure of both annular seals 158 and the invasion of drilling fluid into sealed oil chamber 173. Particularly, by having the hard-faced flow restrictor sleeves positioned in-between or at the ends of radial supports 162 it would allow bearing assembly 150 to survive mud invasion of sealed oil chamber 173 and/or a full failure of both annular seals 158 thus simply returning to functioning like a normal mud lubricated bearing assembly directing a minority of the fluid (e.g., 5-30%) flowing along main fluid flowpath 170 to the annulus 18 (bypassing bit 90) through the flow restrictors within radial supports 162.

Located axially above sealed oil chamber 173 is the mud-lubricated bearing section of bearing assembly 150 including ball bearing stack 164. In this embodiment, flow restrictor 166 comprises a short hard-faced flow restrictor/radial bearing that is positioned axially above ball bearing stack 164 to provide radial support to the upper end 152A of bearing mandrel 152 (in at least some applications, significantly lower radial loading is seen at the upper end 152A of bearing mandrel 152 compared to the lower end 1526) and optionally assist in metering the flow to the ball bearing stack 164 along bearing fluid flowpath 172.

In this embodiment, the main fluid flowpath 170 for the drilling fluid passing through bearing assembly 150 extends through annulus 171 and enters the central passage 153 of bearing mandrel 152 through the radial flow ports 154 of bearing mandrel 152. A portion of the drilling fluid flowing along main fluid flowpath 170 is diverted from flowpath 170 to bearing fluid flowpath 172 which passes through ball bearing stack 164 and provide lubrication and cooling thereto. After exiting ball bearing stack 164, this diverted flow (bearing fluid flowpath 172) passes through the lower radial port 157 of bearing mandrel 152 and re-enters the main flowpath 170 flowing through central passage 153 of bearing mandrel 152.

Given that, in at least some applications, there is less pressure drop in bearing fluid flowpath 172 between the upper and lower ends of ball bearing stack 164 compared to a conventional layout which bypasses to the annulus (e.g., to annulus 18, bypassing bit 90), a lesser fluid restriction is required at flow restrictor 166. Additionally, the fluid flow areas of flow restrictor 166 and radial flow ports 154 can be fine-tuned based on the particular application to provide the optimum amount of flow through ball bearing stack 164 for adequate cooling of ball bearing stack 164 while minimizing erosion. In some embodiments, lower radial port 157 of bearing mandrel 152 comprises one or more nozzles each having a predetermined or defined flowrate for a given size to fine tune the amount of fluid diverted to bearing fluid flowpath 172 from main fluid flowpath 170. The radial nozzles of lower radial port 157 wear at a reduced wear rate and provide a more consistent flowrate to ball bearing stack 164 during long run intervals, especially in applications with high sideloading, compared to a set of lower radial flow restrictor sleeves.

Figure 6:
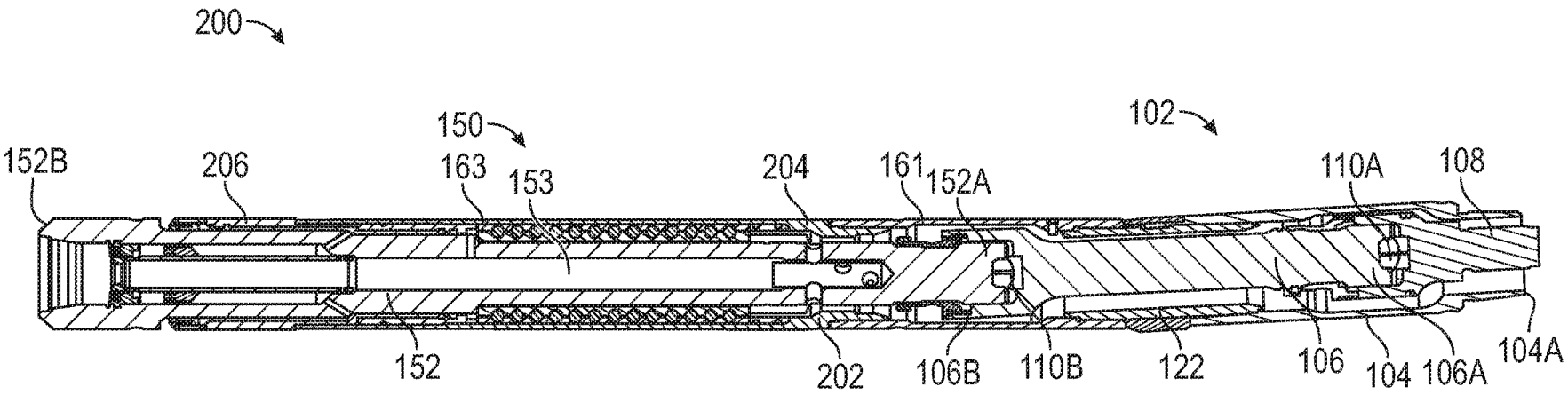
FIG. 6 is a side cross-sectional view of another embodiment of a downhole mud motor of the drilling system of FIG. 1 in accordance with principles disclosed herein.
Figure 7:
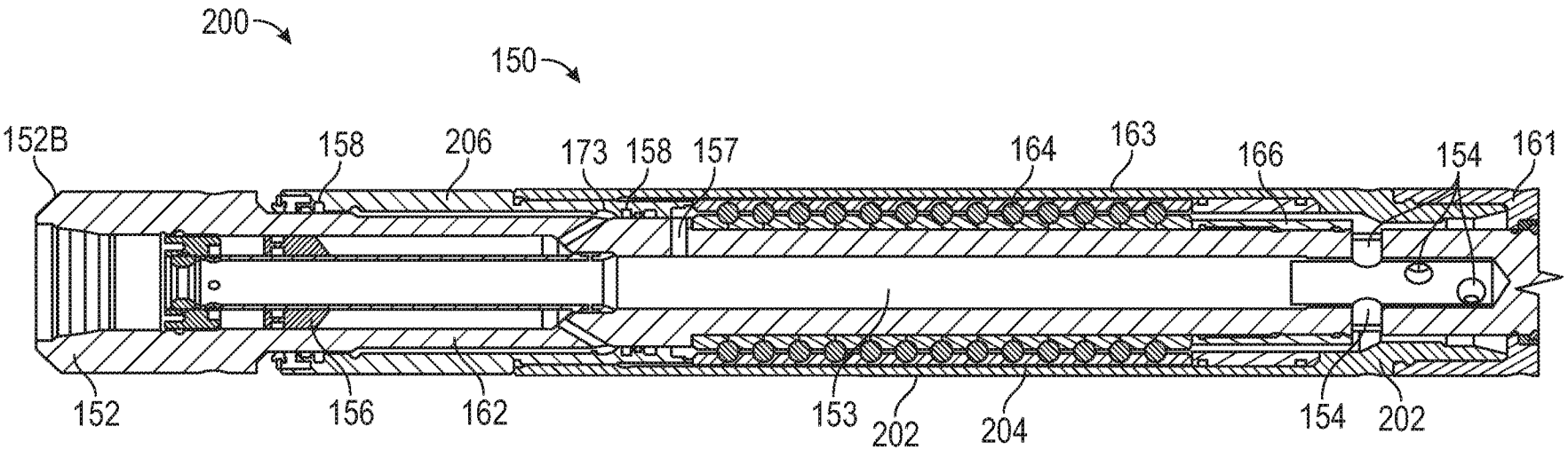
FIG. 7 is a side cross-sectional view of an embodiment of a bearing assembly of the mud motor of FIG. 6 in accordance with principles disclosed herein.

Referring briefly to FIGS. 6, 7, another embodiment of a downhole mud motor 200 for use in the BHA 30 of FIG. 1 is shown in FIGS. 6, 7. The embodiment of FIGS. 6, 7 differs from mud motor 35 shown in FIGS. 4, 5 only in that a bearing assembly 202 of mud motor 200 includes a bearing housing 204 comprising upper housing 161, intermediate housing 163, and a single, integrally or monolithically formed lower housing 206 (in lieu of the separate lower housings 165, 167 of bearing housing 160 shown in FIGS. 4, 5). The single lower housing 206 of bearing housing 204 reduces the axial length and part count of bearing housing 204 relative bearing housing 160 shown in FIGS. 4, 5, but provides less radial support, than bearing housing 160. The reduced radial support provided by bearing housing 204 can be offset by adding more radial support at the upper flow restrictor if desired or lengthening housing 206 to increase the radial bearing contact length.

Referring to FIGS. 8-11, other embodiments of downhole mud motors 250, 300 for use in the BHA 30 of FIG. 1 are shown in FIGS. 8, 9 and FIGS. 10, 11, respectively. Mud motors 250, 300 each include features in common with the mud motor 35 shown in FIGS. 4, 5 except instead of a ball bearing stack (e.g., ball bearing stack 164 shown in FIGS. 4, 5), mud motors 250 and 300 each include thrust bearings 252 (e.g., PDC thrust bearings, etc.). Illustrated in FIGS. 8-11 are single on-bottom and off-bottom bearing pairs of thrust bearings 252, with one of each pair of thrust bearings 252 secured to the bearing housing 160 and the other secured to the bearing mandrel 152, with a split ring 254, a sleeve 267 to capture split ring 254, and a plurality of keys 255 disposed on the bearing mandrel 152 to transfer thrust and torsional loads from each shaft race of thrust bearings 252 to the bearing mandrel 152. Alternatively, in other embodiments, a multiple stack of PDC bearing races could be employed (similar to the ball-bearing stack 164 but with multiple PDC interfaces in contact instead of ball bearings). As with mud motor 35 shown in FIGS. 4, 5, each of mud motors 250, 300 include flow restrictor 166 to help control the amount of drilling fluid flow directed to thrust bearings 252 and to provide some additional radial support thereto. Particularly, a portion of the drilling fluid is diverted from a main fluid flowpath (e.g. similar to the configuration of main fluid flowpath 170 shown in FIG. 5) to thrust bearings 252 (e.g., similar to the configuration of bearing fluid flowpath 172 shown in FIG. 5) which passes through lower radial port 157 in bearing mandrel 152 to converge with the main fluid flowpath.

Figure 8:
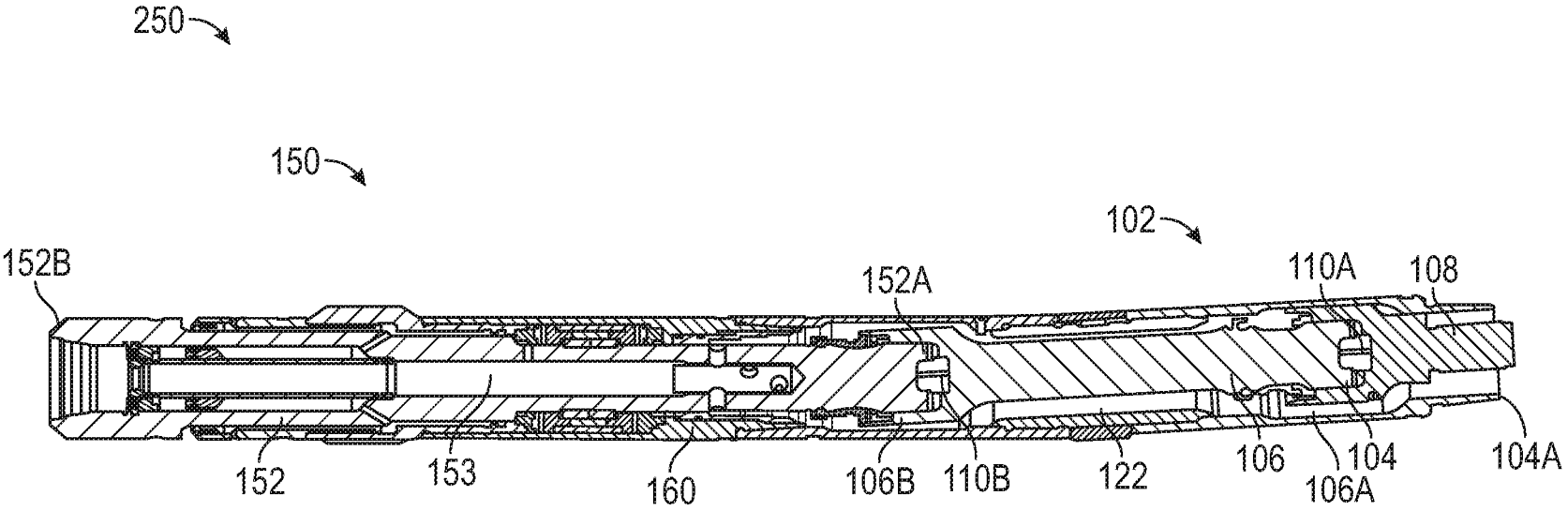
FIG. 8 is a side cross-sectional view of another embodiment of a downhole mud motor of the drilling system of FIG. 1 in accordance with principles disclosed herein.
Figure 9:
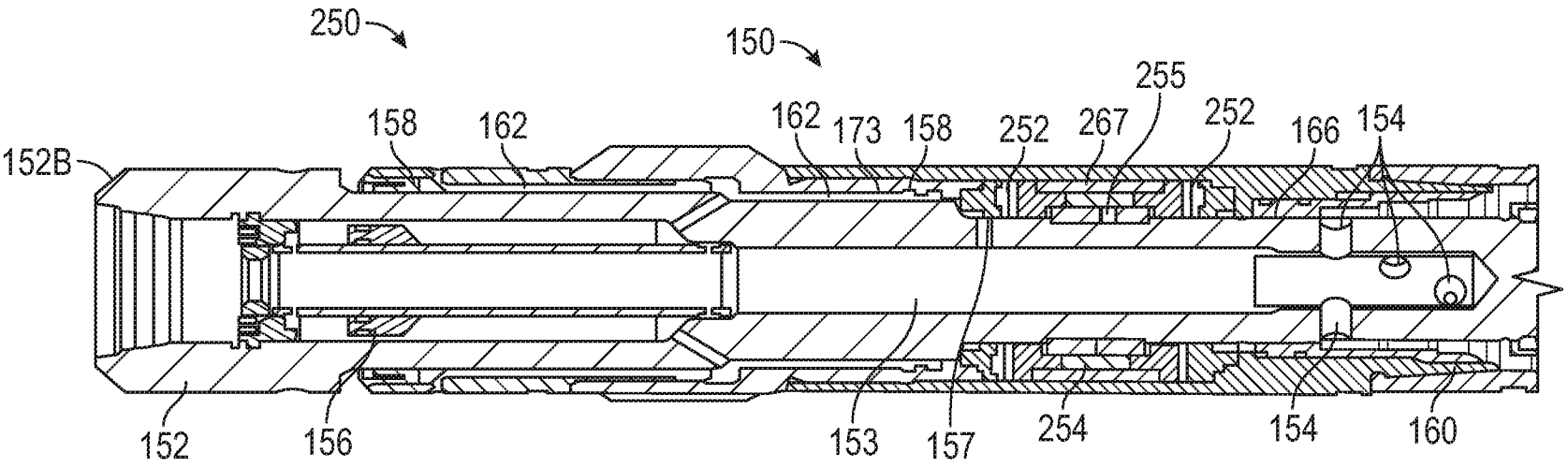
FIG. 9 is a side cross-sectional view of an embodiment of a bearing assembly of the mud motor of FIG. 8 in accordance with principles disclosed herein.
Figure 10:
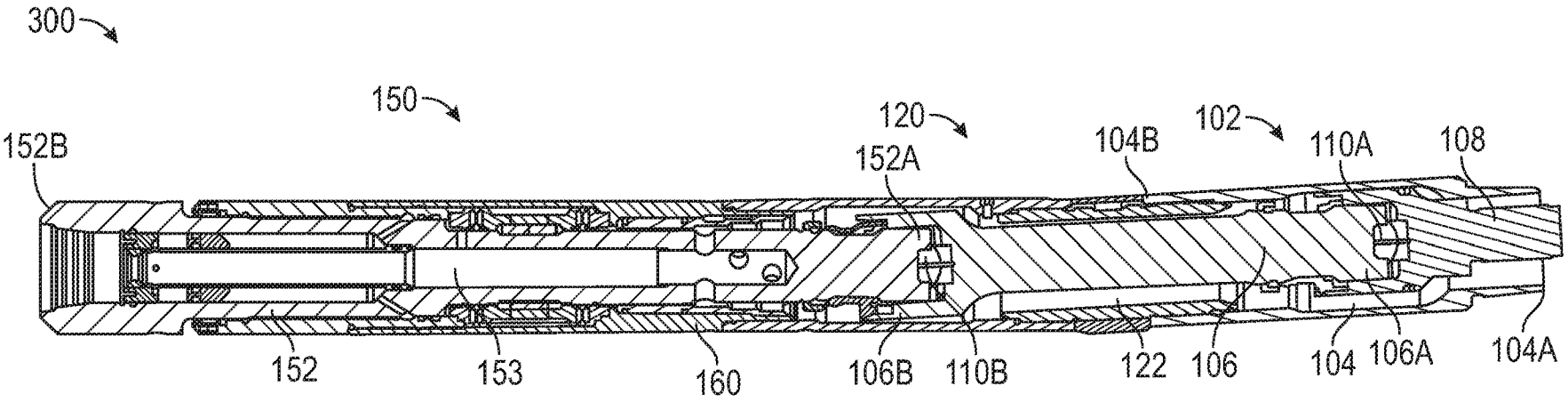
FIG. 10 is a side cross-sectional view of another embodiment of a downhole mud motor of the drilling system of FIG. 1 in accordance with principles disclosed herein.
Figure 11:
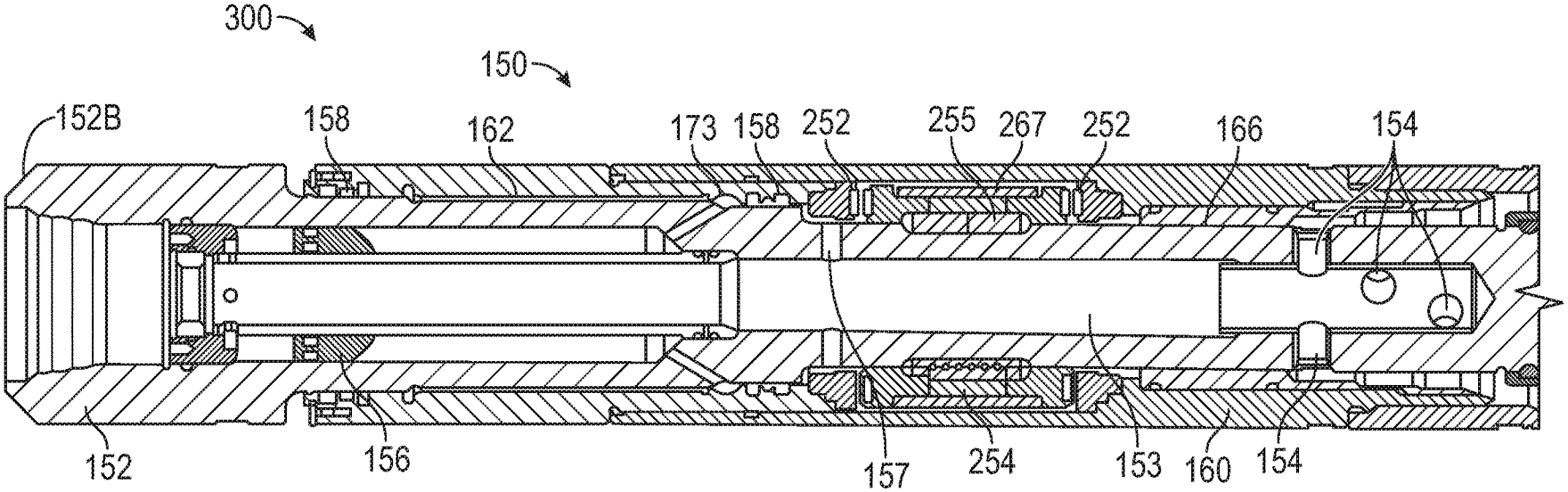
FIG. 11 is a side cross-sectional view of an embodiment of a bearing assembly of the mud motor of FIG. 10 in accordance with principles disclosed herein.

As shown particularly in FIG. 9, in the embodiment of FIGS. 8, 9, flow restrictor 166 may comprise an axial sliding sleeve, a flow control valve, and/or a pressure control valve. In some embodiments, flow restrictor 166 comprises a sliding sleeve valve including a spring biasing the sliding sleeve valve such that the valve acts as a flow control valve or pressure control valve to ball bearing stack 164. Alternatively, in some embodiments, a flow control valve or pressure control valve is positioned below thrust bearings 252 but above the radial port 157 to control flow along bearing fluid flowpath 172 in response to a pressure or flow control mechanism which could be hydraulically or spring biased. Additionally, this flow control or pressure control mechanism could be positioned below thrust bearings 252 and disposed either in the lower radial port 157 of the bearing mandrel 152 or comprise a sliding sleeve positioned at the lower end of the thrust bearings 252 in the central passage 153 of bearing mandrel 152. The flow control valves and flow or pressure control mechanisms allow the flow to the thrust bearings 252 along bearing fluid flowpath 172 to be kept at a more consistent rate across a large mud weight range and flowrate range compared with conventional designs that may lead to bearing failures.

Also as shown particularly in FIG. 9, the radial supports or bushings 162 in this embodiment may comprise a combination of PDC diamond radial bearings and flow restrictors described above, placed in-between a series of radial bushings. With annular seals 158 (e.g., Kalsi Seals®) placed above and below radial supports 162, this design could provide substantially 100% flow to the bit with no bypass flow to the annulus. This configuration could thereby provide a second level of protection to allow the motor to drill ahead and finish the well even if both of the annular seals 158 completely failed and mud invaded the motor's bearing pack (e.g., thrust bearings 252). By having the PDC diamond radial bearings in between or at the ends of the lower radial bushing it would allow the hybrid motor's bearing pack to survive mud invasion or a full failure of both the annular seals 158 thus simply returning to functioning like a normal mud lubricated bearing assembly where it would begin to bypass 5-30% flow to the annulus through the PDC diamond radial bearings and flow restrictors.

All of the embodiments shown in FIGS. 4-11 connect to a standard driveshaft and adjustable assembly combination—making use of the robust integral mandrel U-joint and knuckle designs described above. Therefore mud motors 100, 200, 250, and 300 shown in FIGS. 4-11 provide the ability to utilize a surface-adjustable motor with the benefits of mud-lubricated bearing capacity and performance, while maintaining an oil-lubricated section for optimal near-bit radial support, with 100% flow to the bit.

Referring to FIGS. 12, 14 and 21, 22, other embodiments of downhole mud motors 350 (FIGS. 12, 14), 600 (FIGS. 21, 22) for use with well system 10 of FIG. 1 is shown. Mud motors 350, 600 each include features in common with the mud motor 35 shown in FIGS. 4, 5. However, unlike mud motor 35 shown in FIGS. 4, 5, the embodiments of mud motor 350 shown in FIGS. 12, 14 and mud motor 750 shown in FIGS. 21, 22, respectively, each comprise downhole-adjustable bent-motor embodiments including a downhole-adjustable bend adjustment assembly 400, as will be described further herein. Similar to the preceding embodiments shown in FIGS. 4-11, the lower sections of the bearing assemblies 150 of mud motors 350 and 600 each includes upper and lower annular seals 158 defining sealed oil chamber 173, with the balancing or pressure compensating piston 156 disposed within the bore of the bearing mandrel 152, and radial supports or bushings 162 positioned between the bearing housing 160 and bearing mandrel 152. Additionally, in the embodiments of FIGS. 12, 14, 21, and 22, an actuator assembly or locking differential or assembly 500 is positioned within the oil chamber 173 defined by annular seals 158. Sealed oil chamber 173 provides an optimum environment for the locking assembly 500, as well as the benefits of substantial radial support close to the bit box (e.g., lower end 152B of bearing mandrel 152) and full sealing between the bearing mandrel 152 and bearing housing 160, ensuring full flow of drilling fluid to drill bit 90.

Figure 21:
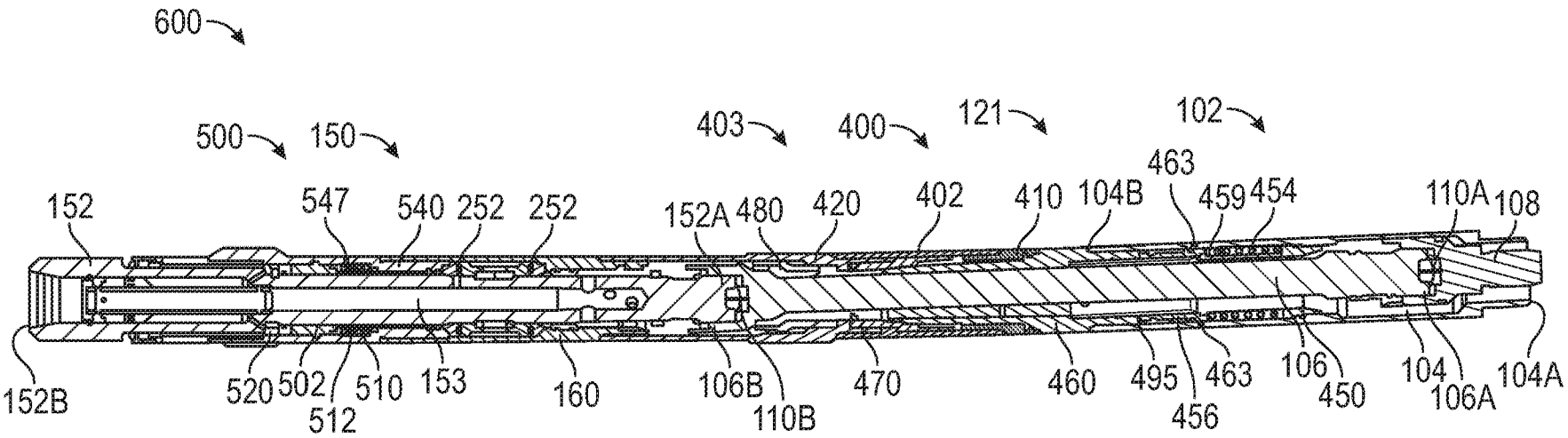
FIG. 21 is a side cross-sectional view of another embodiment of a downhole mud motor of the drilling system of FIG. 1 in accordance with principles disclosed herein.
Figure 22:
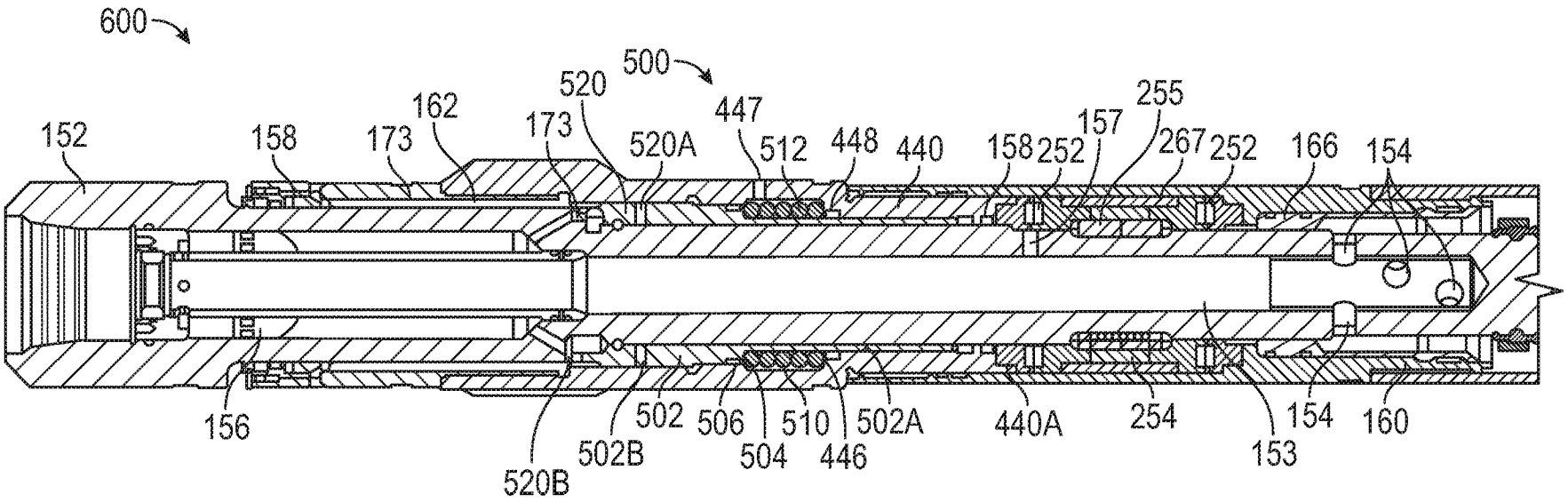
FIG. 22 is a side cross-sectional view of an embodiment of a bearing assembly of the mud motor of FIG. 21 in accordance with principles disclosed herein.
Figure 23:
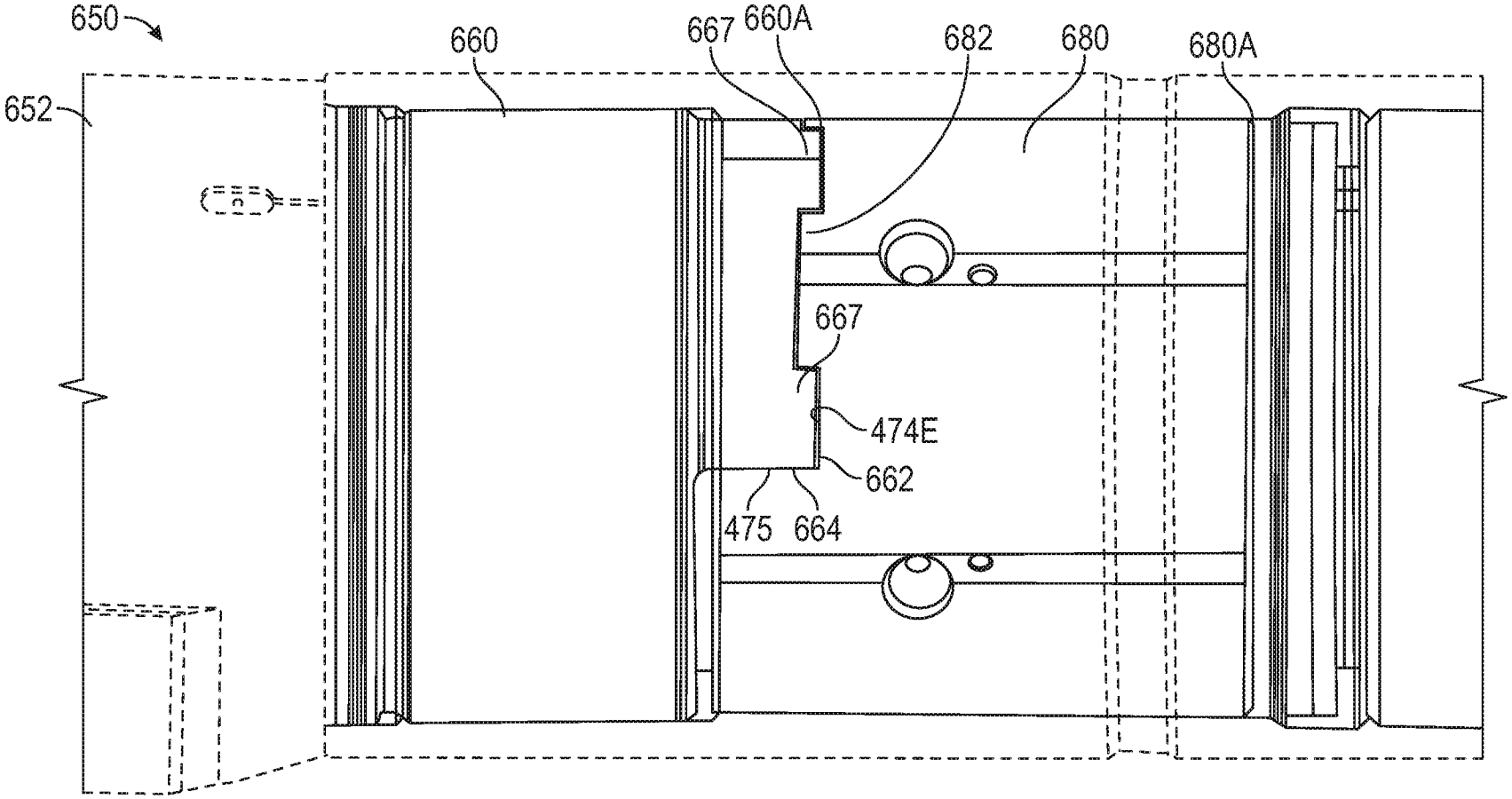
FIG. 23 is a side cross-sectional view of another embodiment of a downhole mud motor of the drilling system of FIG. 1 in accordance with principles disclosed herein.
Figure 24:
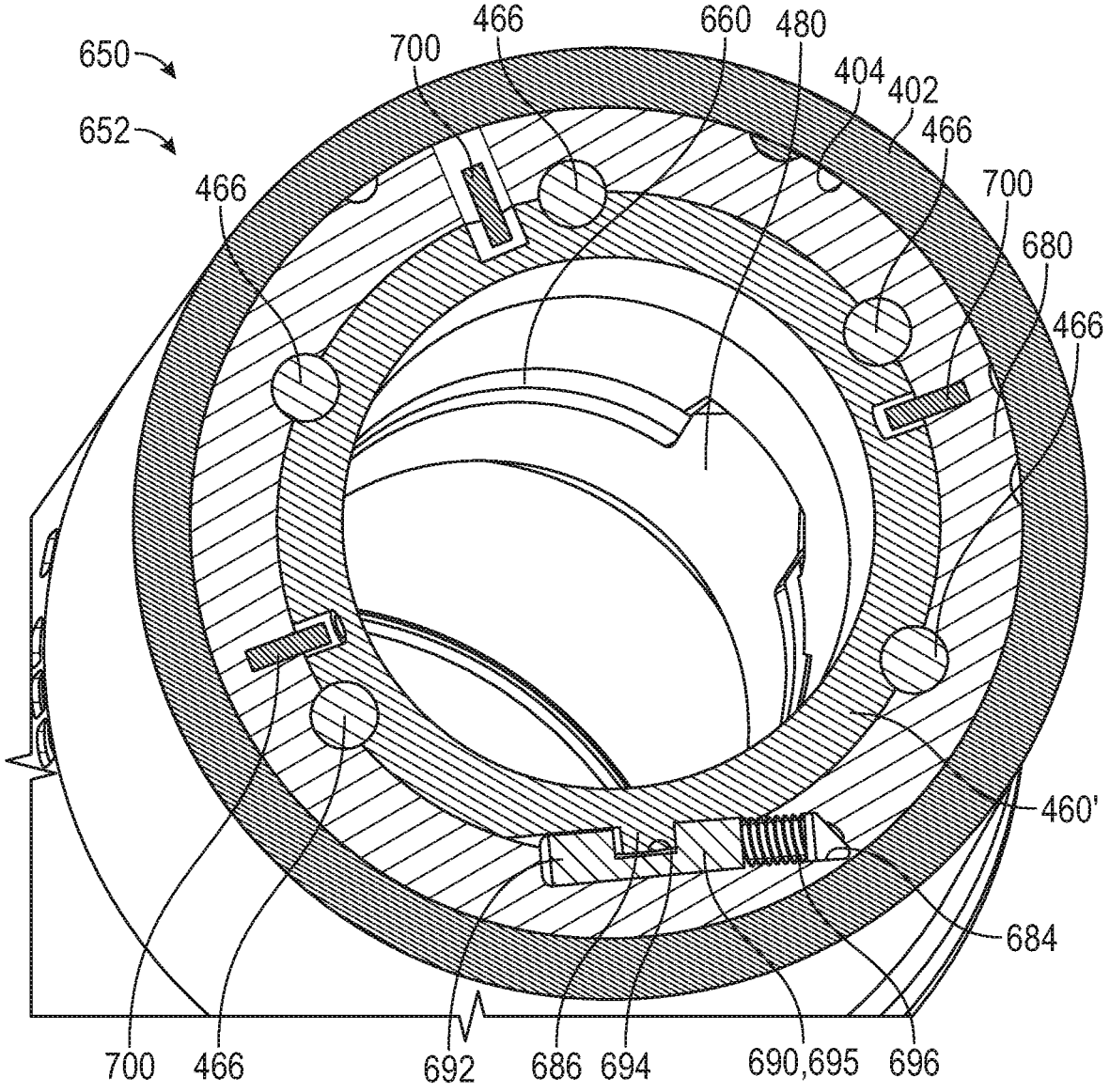
FIG. 24 is a perspective cross-sectional view of an embodiment of a bend adjustment assembly of the mud motor of FIG. 23 in accordance with principles disclosed herein.
Figure 25:
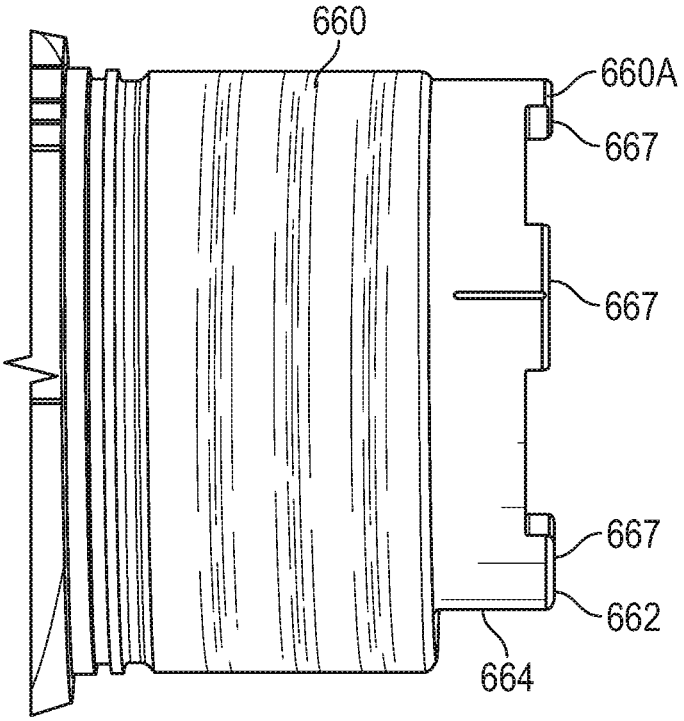
FIG. 25 is a side view of an embodiment of a lower offset housing of the bend adjustment assembly of FIG. 24 in accordance with principles disclosed herein.
Figure 26:
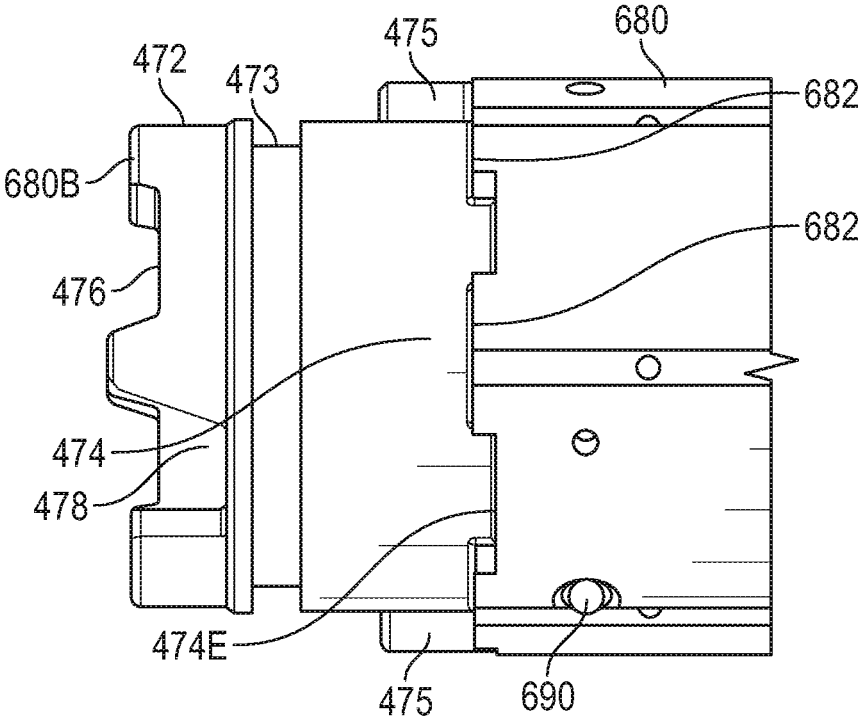
FIG. 26 is a side view of an embodiment of a lower offset mandrel or lug housing of the bend adjustment assembly of FIG. 24 in accordance with principles disclosed herein.
Figure 27:
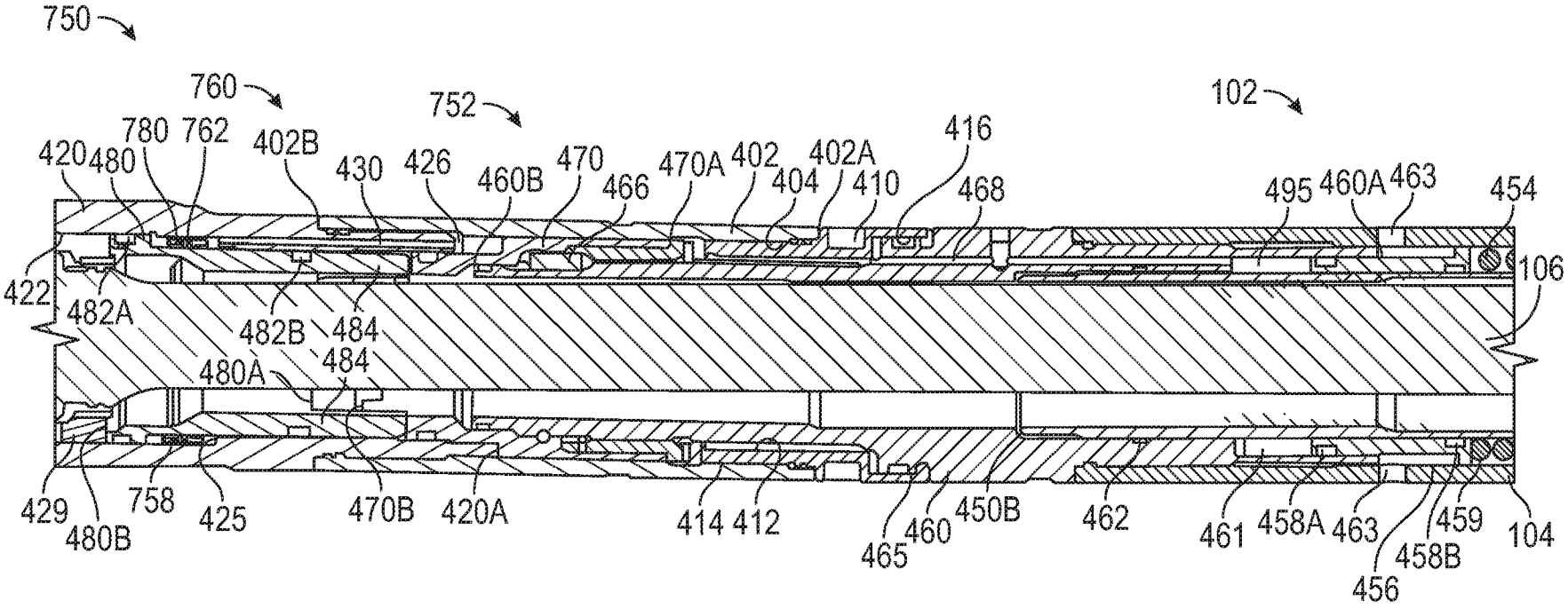
FIG. 27 is a side cross-sectional view of another embodiment of a downhole mud motor of the drilling system of FIG. 1 in accordance with principles disclosed herein.
Figure 28:
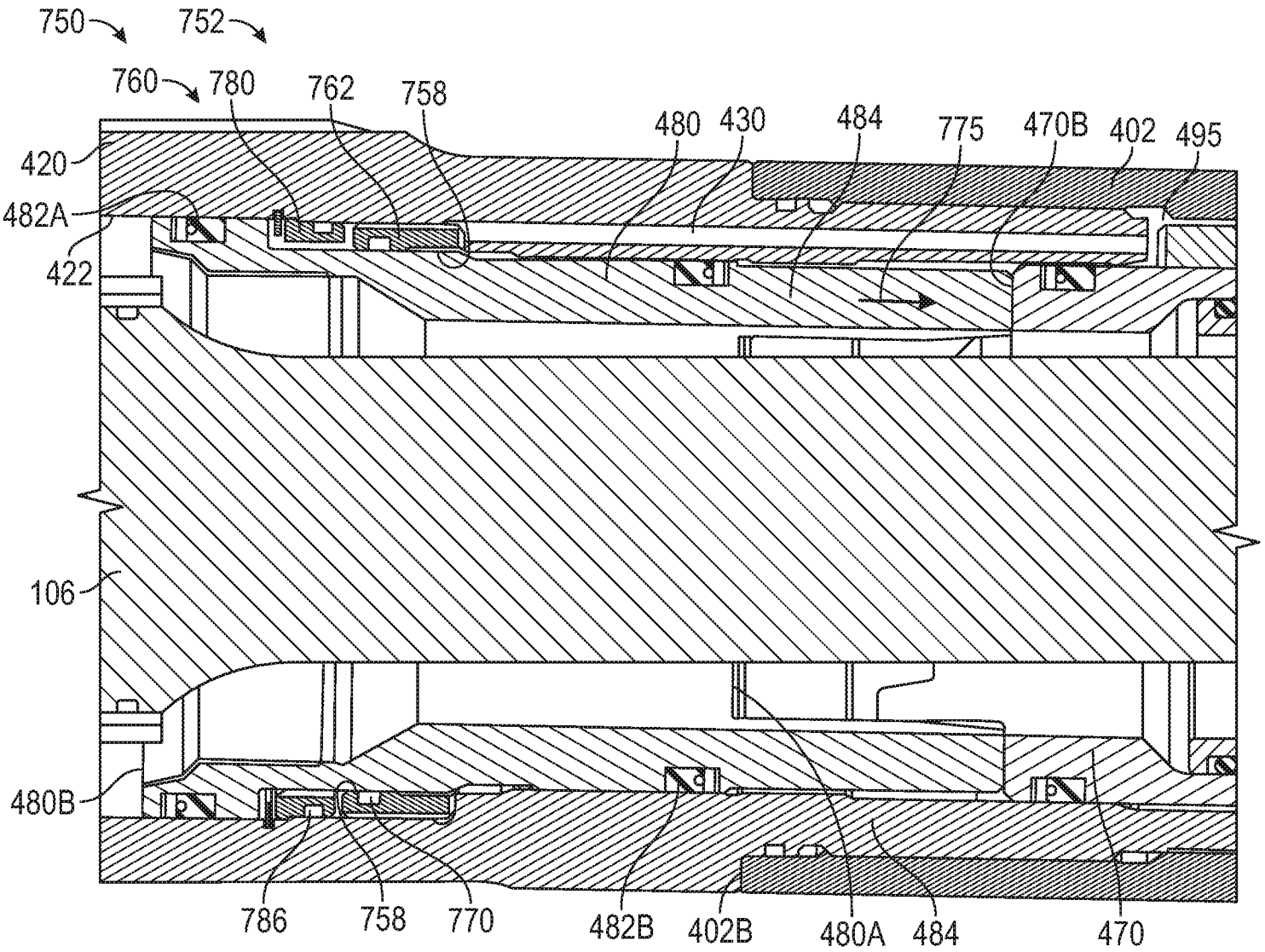
FIGS. 28, 29 are side cross-sectional views of an embodiment of a fluid metering assembly of the mud motor of FIG. 27 in accordance with principles disclosed herein.
Figure 29:
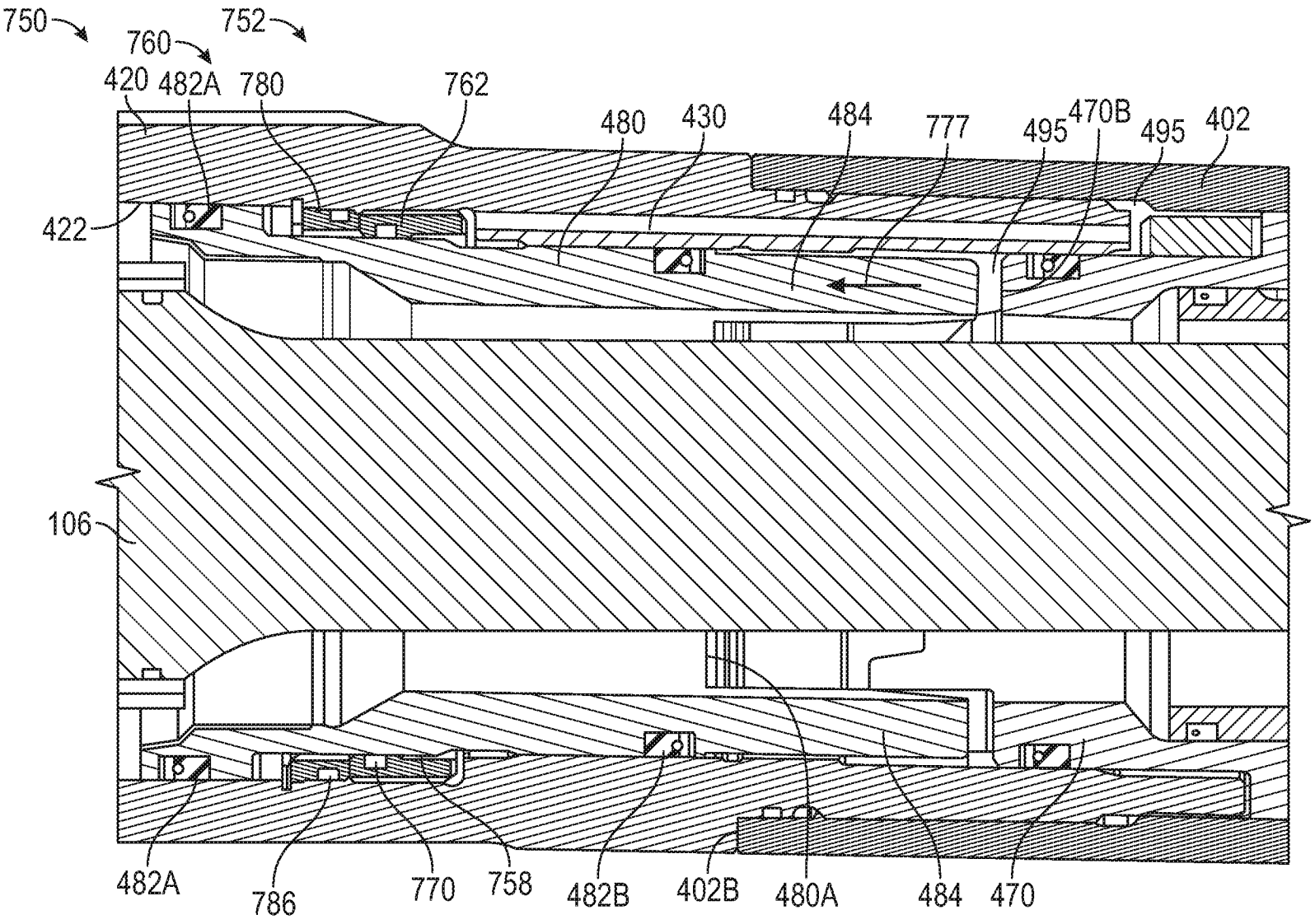
Figure 30:
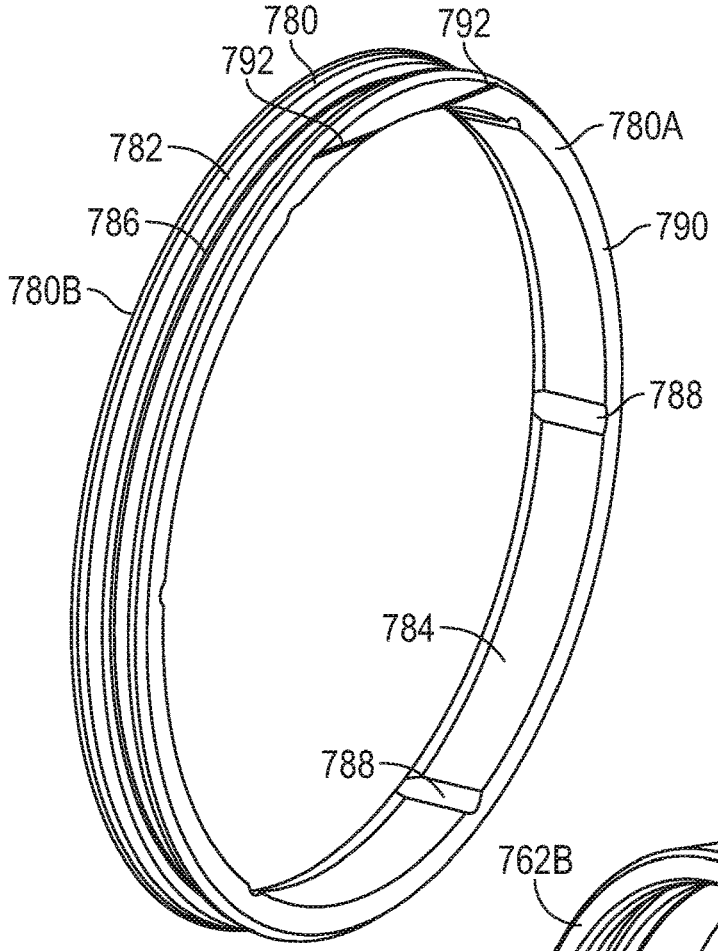
FIG. 30 is a perspective view of an embodiment of a seal body of the fluid metering assembly of FIGS. 28, 29 in accordance with principles disclosed herein.

As in the preceding embodiments shown in FIGS. 4-11, axially above sealed oil chamber 173 of mud motors 350, 600 is the location of the mud-lubricated bearing section. Mud motor 350 shown in FIGS. 12, 14 includes ball bearing stack 164 while mud motor 750 shown in FIGS. 21, 22 includes thrust bearings 252, where locking assembly 500 is positioned axially between the lower end 152B of bearing mandrel 150 and either ball bearing stack 164 (FIGS. 12, 14) or thrust bearings 252 (FIGS. 21, 22). The flowpath through the bearings (e.g., bearing flowpath 172 shown in FIG. 5) and the use of flow restrictor 166 is similar as with the preceding embodiments shown in FIGS. 4-11. Both embodiments of FIGS. 12, 14, 21, and 22 connect to the driveshaft/choke section and downhole-adjustable section of bend adjustment assembly 400. Mud motors 350, 600 each provide the ability to utilize a downhole-adjustable motor with the benefits of mud-lubricated bearing capacity and performance, while maintaining an oil-lubricated section defined by sealed oil chamber 173 for optimal performance of the locking differential and near-bit radial support, with substantially 100% flow to drill bit 90.

Each of mud motors 100, 200, 250, 300, 350, and 600 described above can alternatively use mechanical seals, such as the mechanical seals disclosed in U.S. Pat. No. 8,827,562 which is incorporated herein by reference for the entirety of its teachings, in place of one or both annular seals 158 as a secondary sealing option. The use of mechanical seals in these locations could provide additional robustness in high temperature or high rotational speed applications where annular seals 158 (e.g., Kalsi Seals® or other types of rotary seals) may have issues with longevity. As shown in FIGS. 4, 5, 12, and 13, in some embodiments, one or both rotary seals of this application could be replaced by the sealing plates shown in FIG. 2 of U.S. Pat. No. 8,827,562. The sealing plates would seal up one or both ends of the oil chamber and provide a robust high temperature barrier. Incorporation of the sealing plate can be swapped into any of the embodiments shown in FIGS. 4-12, 14.

Referring to FIGS. 1, 12-20, mud motor 350 for use with the well system 1 of FIG. 1 is shown in FIGS. 12-20. In some embodiments, bend adjustment assembly 400 includes features in common with the bend adjustment assemblies shown and described in U.S. patent application Ser. No. 16/007,545 (published as US 2018/0363380), which is incorporated herein by reference in their entirety. In the embodiment of FIGS. 1, 12-20, to drill a straight section of borehole 16, drill string 21 is rotated from rig 20 with a rotary table or top drive to rotate BHA 30 and drill bit 90 coupled thereto. Drill string 21 and BHA 30 rotate about the longitudinal axis of drill string 21, and thus, drill bit 90 is also forced to rotate about the longitudinal axis of drill string 21. With the central axis 95 of bit 90 disposed at deflection angle θ, the lower end of drill bit 90 distal BHA 30 seeks to move in an arc about longitudinal axis 25 of drill string 21 as it rotates, but is restricted by the sidewall 19 of borehole 16, thereby imposing bending moments and associated stress on BHA 30 and mud motor 350. In general, the magnitudes of such bending moments and associated stresses are directly related to the bit-to-bend distance D—the greater the bit-to-bend distance D, the greater the bending moments and stresses experienced by BHA 30 and mud motor 350.

As will be discussed further herein, bend adjustment assembly 400 of mud motor 350 is configured to actuate between a first or the unbent position, and a second or bent position 403 (shown in FIGS. 12, 13) providing bend 121 and deflection angle θ between the longitudinal axis 95 of drill bit 90 and the longitudinal axis 25 of drill string 21. In other embodiments, bend adjustment assembly 400 is configured to actuate between the unbent position, a first bent position providing a first non-zero deflection angle $\theta_1$, and a second bent position providing a second non-zero deflection angle $\theta_2$ which is different from the first deflection angle $\theta_1$.

Bend adjustment assembly 400 couples driveshaft housing 104 to bearing housing 160, and selectably introduces deflection angle θ along BHA 30. Central axis 105 of driveshaft housing 104 is coaxially aligned with axis 25, and central axis 215 of bearing housing 160 is coaxially aligned with axis 95, thus, deflection angle θ also represents the angle between axes 105, 215 when mud motor 350 is in an undeflected or unbent position (e.g., outside borehole 16). When bend adjustment assembly 400 is in the unbent position, central axis 105 of driveshaft housing 104 extends substantially parallel with the central axis 215 of bearing housing 160. Additionally, bend adjustment assembly 400 is configured to adjust the degree of bend provided by mud motor 350 without needing to pull drill string 21 from borehole 16 to adjust bend adjustment assembly 400 at the surface, thereby reducing the amount of time required to drill borehole 16.

In this embodiment, bend adjustment assembly 400 generally includes a first or upper offset housing 402, an upper housing extension 410 (shown in FIG. 13), a second or lower offset housing 420, a clocker or actuator housing 440, a piston mandrel 450, a first or upper adjustment mandrel 460, a second or lower adjustment mandrel or lug housing 470, and a locking piston 490. Additionally, in this embodiment, bend adjustment assembly 400 includes a locker or actuator assembly 500 housed in the actuator housing 440, where locker assembly 500 is generally configured to control the actuation of bend adjustment assembly between the unbent position and bent position 403 with BHA 30 disposed in borehole 16.

Figure 13:
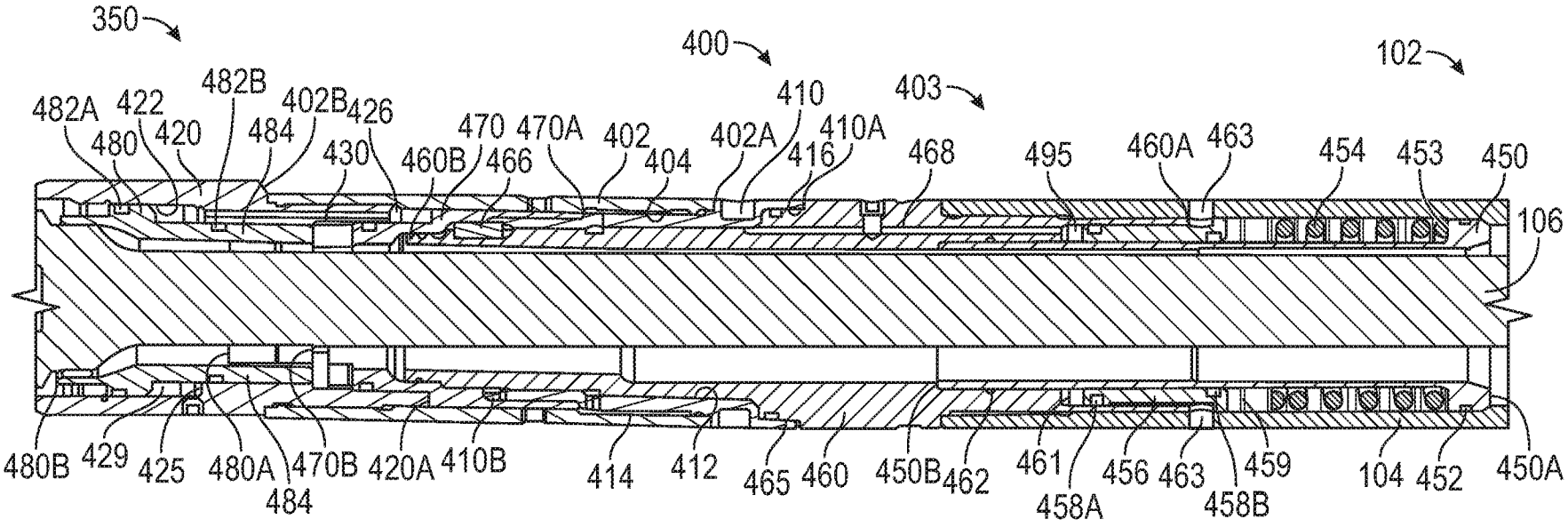
FIG. 13 is a side cross-sectional view of an embodiment of a bend adjustment assembly of the mud motor of FIG. 12 in accordance with principles disclosed herein.

As shown particularly in FIG. 13, upper offset housing 402 of bend adjustment assembly 400 is generally tubular and has a first or upper end 402A, a second or lower end 402B opposite upper end 402A, and a central bore or passage defined by a generally cylindrical inner surface 404 extending between a ends 402A, 402B. The inner surface 404 of upper offset housing 402 includes a first or upper threaded connector extending from upper end 402A, and a second or lower threaded connector extending from lower end 402B and coupled to lower offset housing 420. Upper housing extension 410 is generally tubular and has a first or upper end 410A, a second or lower end 410B, a central bore or passage defined by a generally cylindrical inner surface 412 extending between ends 410A and 410B, and a generally cylindrical outer surface 414 extending between ends 410A and 410B. In this embodiment, the inner surface 412 of upper housing extension 410 includes an engagement surface 416 extending from upper end 410A that matingly engages an offset engagement surface 465 of upper adjustment mandrel 460. Additionally, in this embodiment, the outer surface 414 of upper housing extension 410 includes a threaded connector coupled with the upper threaded connector of upper offset housing 402.

Figure 12:
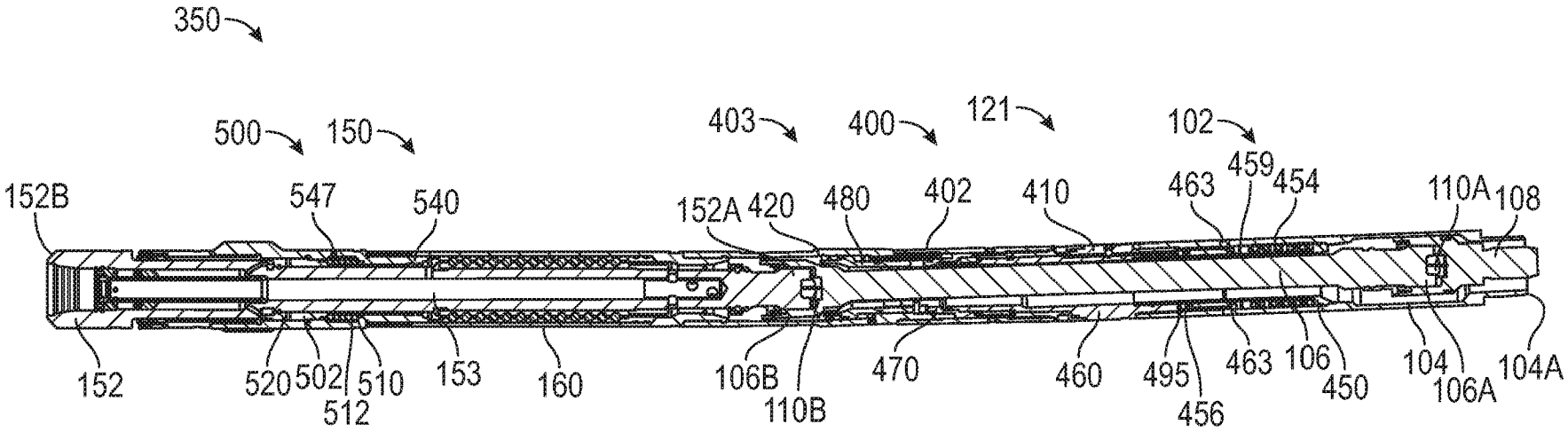
FIG. 12 is a side cross-sectional view of another embodiment of a downhole mud motor of the drilling system of FIG. 1 in accordance with principles disclosed herein.
Figure 15:
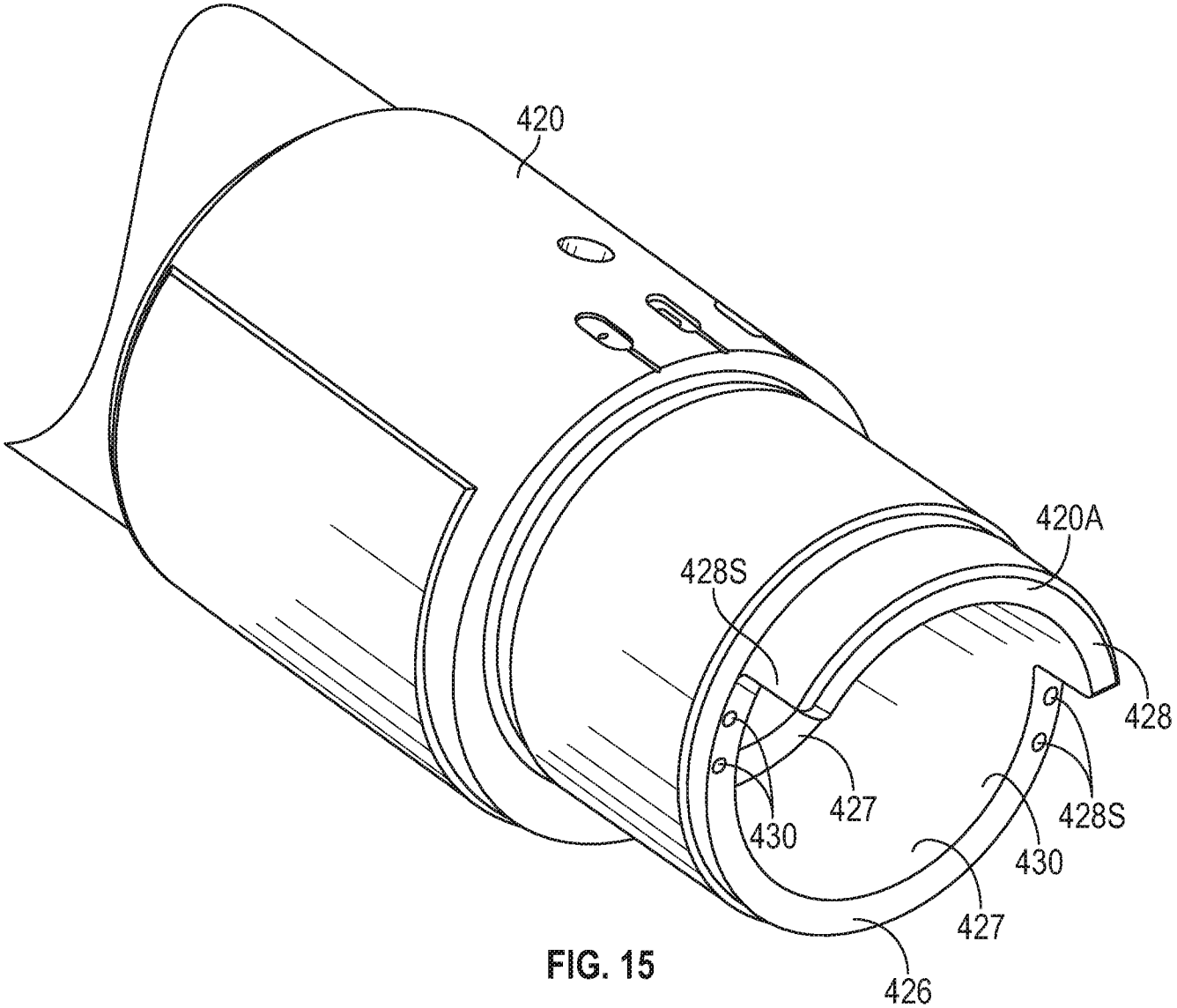
FIG. 15 is a perspective view of an embodiment of a lower offset housing of the bend adjustment assembly of FIG. 13.
Figure 16:
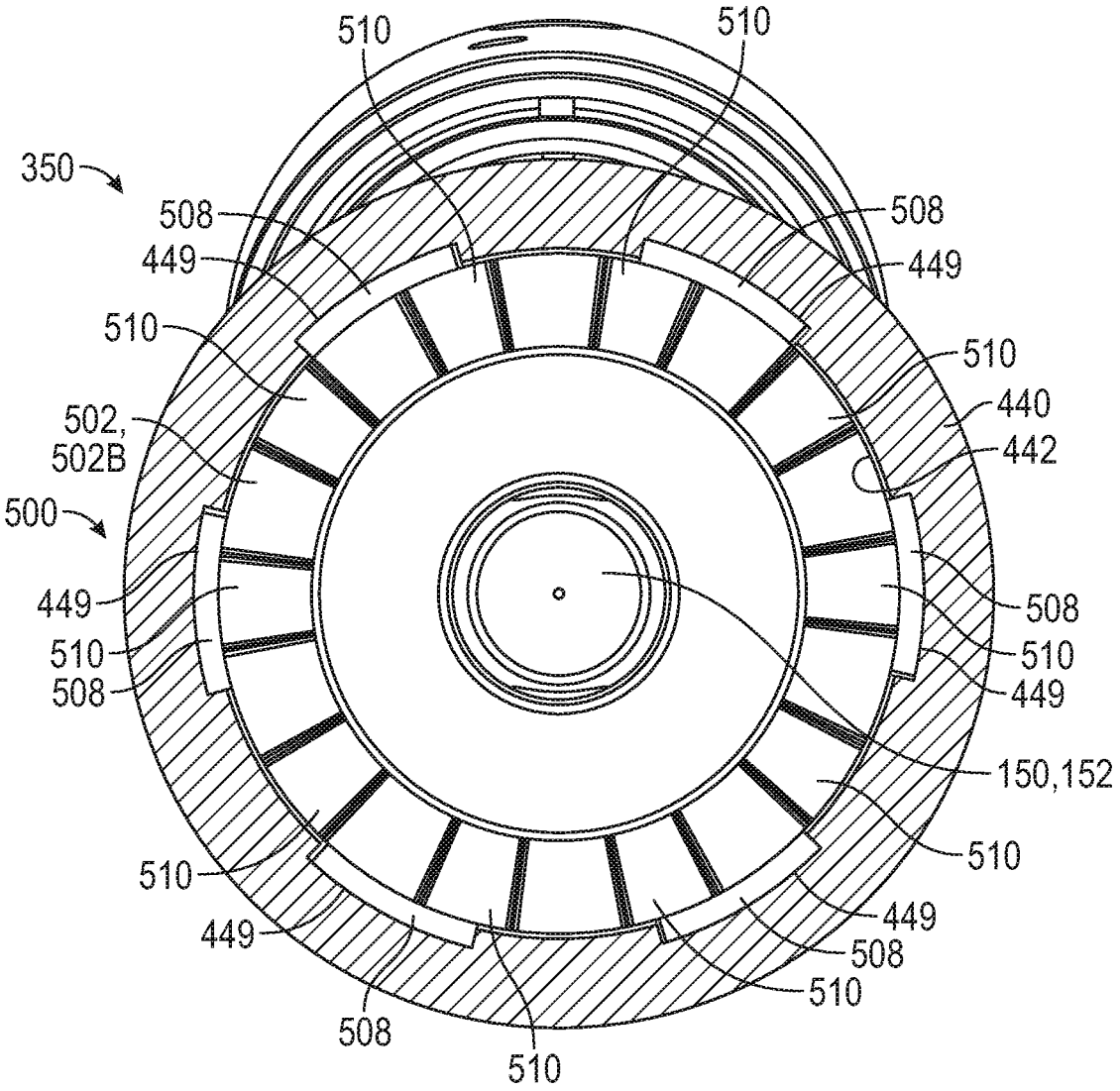
FIG. 16 is a cross-sectional view of the mud motor of FIG. 12 along line 16-16 of FIG. 14.

As shown particularly in FIGS. 12, 13, and 15, the lower offset housing 420 of bend adjustment assembly 400 is generally tubular and has a first or upper end 420A, a second or lower end 420B, and a generally cylindrical inner surface 422 extending between ends 420A and 420B. A generally cylindrical outer surface of lower offset housing 420 includes a threaded connector coupled to the threaded connector of upper offset housing 410. The inner surface 422 of lower offset housing 420 includes an offset engagement surface 423 extending from upper end 420A to an internal shoulder 427S (shown in FIG. 15), and a threaded connector extending from lower end 420B. In this embodiment, offset engagement surface 423 defines an offset bore or passage 427 (shown in FIG. 15) that extends between upper end 420A and internal shoulder 427S of lower offset housing 420.

Additionally, lower offset housing 420 includes a central bore or passage 429 extending between lower end 420B and internal shoulder 427S, where central passage 429 has a central axis disposed at an angle relative to a central axis of offset bore 427. In other words, offset engagement surface 423 has a central or longitudinal axis that is offset or disposed at an angle relative to a central or longitudinal axis of lower offset housing 420. Thus, in this embodiment, the offset or angle formed between central bore 429 and offset bore 427 of lower offset housing 420 facilitates the formation of bend 121 described above. In this embodiment, the inner surface 422 of lower offset housing 420 additionally includes an internal upper annular shoulder 425 (shown in FIG. 13) positioned in central bore 429, and an internal lower annular shoulder 426.

In this embodiment, lower offset housing 420 of bend adjustment assembly 400 includes an arcuate, axially extending locking member or shoulder 428 at upper end 420A. Particularly, locking shoulder 428 extends arcuately between a pair of axially extending shoulders 428S. In this embodiment, locking shoulder 428 extends less than 180° about the central axis of lower offset housing 420; however, in other embodiments, the arcuate length or extension of locking shoulder 428 may vary. Additionally, lower offset housing 420 includes a plurality of circumferentially spaced and axially extending ports 430. Particularly, ports 430 extend axially between internal shoulders 425, 426 of lower offset housing 420. As will be discussed further herein, ports 430 of lower offset housing 420 provide fluid communication through a generally annular compensation or locking chamber 495 (shown in FIG. 13) of bend adjustment assembly 400.

Figure 14:
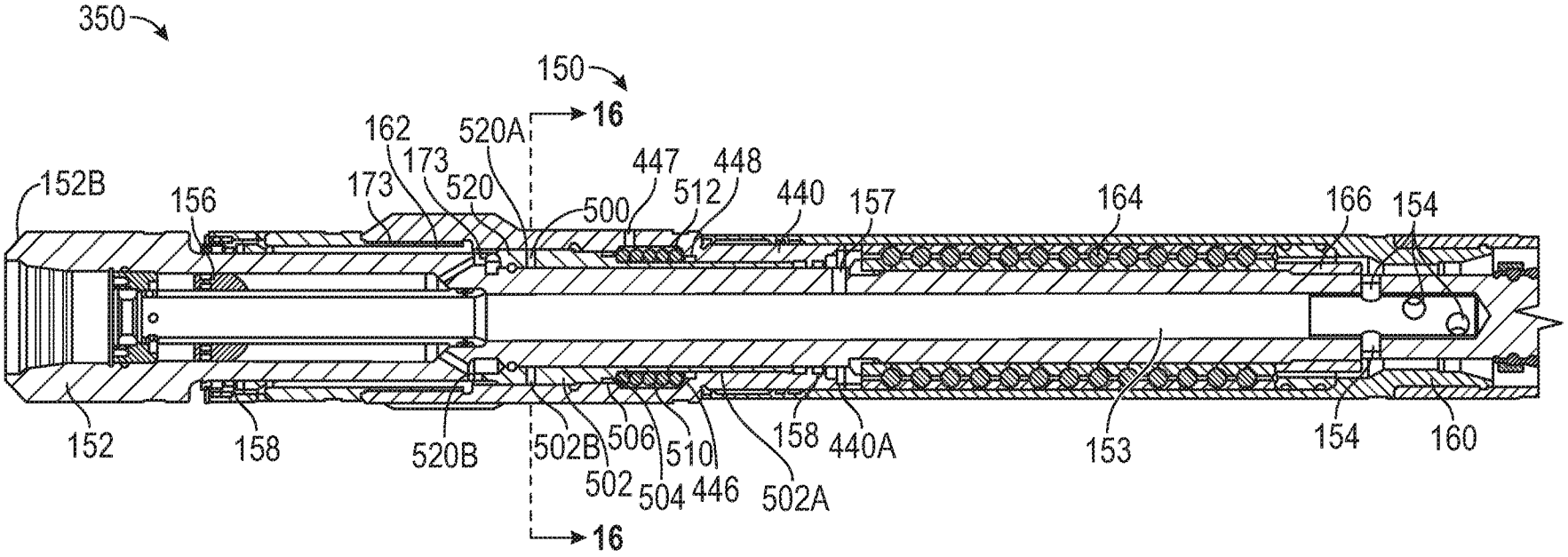
FIG. 14 is a side cross-sectional view of an embodiment of a bearing assembly of the mud motor of FIG. 12 in accordance with principles disclosed herein.

As shown particularly in FIG. 14, actuator housing 440 of bend adjustment assembly 400 houses the locker assembly 500 of bend adjustment assembly 400 and threadably couples bend adjustment assembly 400 with bearing assembly 200. Actuator housing 440 is generally tubular and has a first or upper end 440A, a second or lower end 440B, and a central bore or passage defined by the generally cylindrical inner surface 442 extending between ends 440A and 440B. A generally cylindrical outer surface of actuator housing 440 includes a threaded connector at upper end 440A that is coupled with a threaded connector positioned at the lower end 420B of lower offset housing 420.

In this embodiment, the inner surface 442 of actuator housing 440 includes a threaded connector at lower end 440B, an annular shoulder 446, and a port 447 that extends radially between inner surface 442 and the outer surface of actuator housing 440. A threaded connector positioned on the inner surface 442 of actuator housing 440 couples with a corresponding threaded connector disposed on an outer surface of bearing housing 160 at an upper end thereof to thereby couple bend adjustment assembly 400 with bearing assembly 200. In this embodiment, the inner surface 442 of actuator housing 440 additionally includes an annular seal 448 located proximal shoulder 446 and a plurality of circumferentially spaced and axially extending slots or grooves 449. As will be discussed further herein, seal 448 and slots 449 are configured to interface with components of locker assembly 500.

As shown particularly in FIG. 13, piston mandrel 450 of bend adjustment assembly 400 is generally tubular and has a first or upper end 450A, a second or lower end 450B, and a central bore or passage extending between ends 450A and 450B. Additionally, in this embodiment, piston mandrel 450 includes a generally cylindrical outer surface comprising an annular seal 452 located at upper end 450A that sealingly engages the inner surface of driveshaft housing 104. Further, piston mandrel 450 includes an annular shoulder 453 located proximal upper end 450A that physically engages or contacts an annular biasing member 454 extending about the outer surface of piston mandrel 450. In this embodiment, an annular compensating piston 456 is slidably disposed about the outer surface of piston mandrel 450. Compensating piston 456 includes a first or outer annular seal 458A disposed in an outer cylindrical surface of piston 456, and a second or inner annular seal 458B disposed in an inner cylindrical surface of piston 456, where inner seal 458B sealingly engages the outer surface of piston mandrel 450.

Also as shown particularly in FIG. 13, upper adjustment mandrel 460 of bend adjustment assembly 400 is generally tubular and has a first or upper end 460A, a second or lower end 460B, and a central bore or passage defined by a generally cylindrical inner surface extending between ends 460A and 460B. In this embodiment, the inner surface of upper adjustment mandrel 460 includes an annular recess 461 extending axially into mandrel 460 from upper end 460A, and an annular seal 462 axially spaced from recess 461 and configured to sealingly engage the outer surface of piston mandrel 450. The inner surface of upper adjustment mandrel 460 additionally includes a threaded connector coupled with a threaded connector on the outer surface of piston mandrel 450 at the lower end 450B thereof. In this embodiment, outer seal 458A of compensating piston 456 sealingly engages the inner surface of upper adjustment mandrel 460, restricting fluid communication between locking chamber 495 and a generally annular compensating chamber 459 formed about piston mandrel 450 and extending axially between seal 452 of piston mandrel 450 and outer seal 458A of compensating piston 456. In this configuration, compensating chamber 459 is in fluid communication with the surrounding environment (e.g., borehole 16) via ports 463 in driveshaft housing 104.

In this embodiment, upper adjustment mandrel 460 includes a generally cylindrical outer surface comprising a first or upper threaded connector, and an offset engagement surface 465. The upper threaded connector extends from upper end 460A and couples to a threaded connector disposed on the inner surface of driveshaft housing 104 at a lower end thereof. Offset engagement surface 465 has a central or longitudinal axis that is offset from or disposed at an angle relative to a central or longitudinal axis of upper adjustment mandrel 460. Offset engagement surface 465 matingly engages the engagement surface 416 of upper offset housing 402. In this embodiment, relative rotation is permitted between upper offset housing 402 and upper adjustment mandrel 460 while relative axial movement is restricted between housing 402 and mandrel 460.

Figure 17:
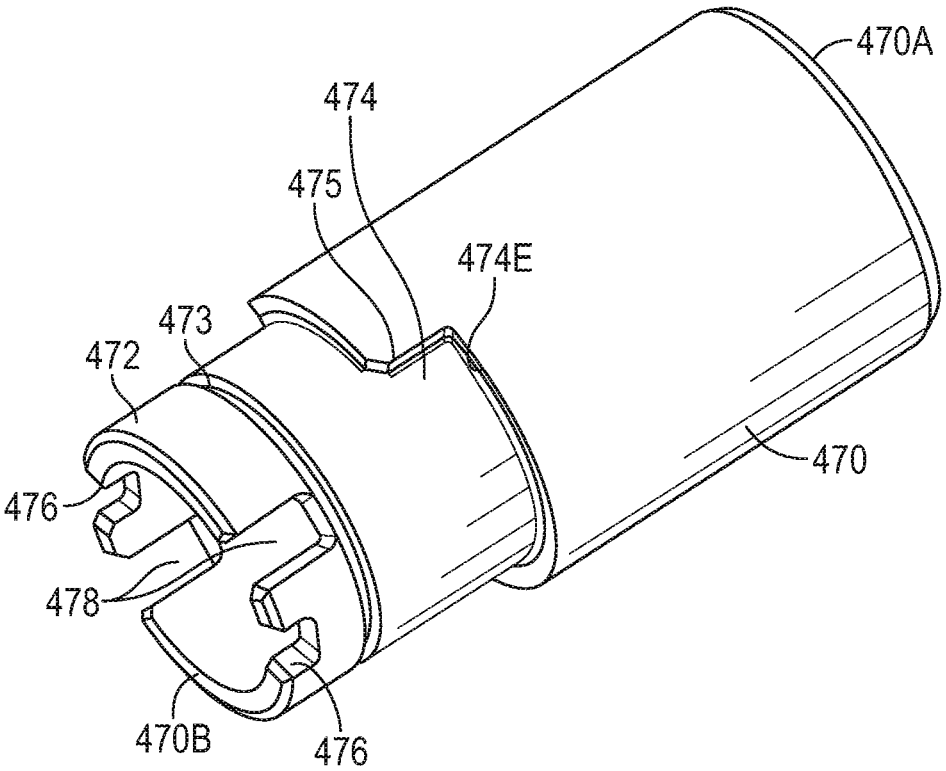
FIG. 17 is a perspective view of an embodiment of a lower adjustment mandrel of the bend adjustment assembly of FIG. 13 in accordance with principles disclosed herein.

As shown particularly in FIGS. 13, 17, lower adjustment mandrel 470 of bend adjustment assembly 400 is generally tubular and has a first or upper end 470A, a second or lower end 470B, and a central bore or passage extending therebetween that is defined by a generally cylindrical inner surface. In this embodiment, one or more splines 466 positioned radially between lower adjustment mandrel 470 and upper adjustment mandrel 460 restricts relative rotation between mandrels 460, 470. Additionally, lower adjustment mandrel 470 includes a generally cylindrical outer surface comprising an offset engagement surface 472, an annular seal 473, and an arcuately extending recess 474 (shown in FIG. 17). Offset engagement surface 472 has a central or longitudinal axis that is offset or disposed at an angle relative to a central or longitudinal axis of the upper end 460A of upper adjustment mandrel 460 and the lower end 420B of lower housing 420, where offset engagement surface 472 is disposed directly adjacent or overlaps the offset engagement surface 423 of lower housing 420. Additionally, the central axis of offset engagement surface 472 is offset or disposed at an angle relative to a central or longitudinal axis of lower adjustment mandrel 470. When bend adjustment assembly 400 is disposed in the unbent position, a first deflection angle is provided between the central axis of lower housing 420 and the central axis of lower adjustment mandrel 470, and when bend adjustment assembly 400 is disposed in the bent position 403, a second deflection angle is provided between the central axis of lower housing 420 and the central axis of lower adjustment mandrel 470 that is different from the first deflection angle.

In this embodiment, an annular seal 473 is disposed in the outer surface of lower adjustment mandrel 470 to sealingly engage the inner surface of lower housing 420. In this embodiment, relative rotation is permitted between lower housing 420 and lower adjustment mandrel 470. Arcuate recess 474 is defined by an inner terminal end 474E and a pair of circumferentially spaced shoulders 475. In this embodiment, lower adjustment mandrel 470 further includes a pair of circumferentially spaced first or short slots 476 and a pair of circumferentially spaced second or long slots 478, where both short slots 476 and long slots 478 extend axially into lower adjustment mandrel 470 from lower end 470B. In this embodiment, each short slot 476 is circumferentially spaced approximately 180° apart. Similarly, in this embodiment, each long slot 478 is circumferentially spaced approximately 180° apart.

Figure 18:
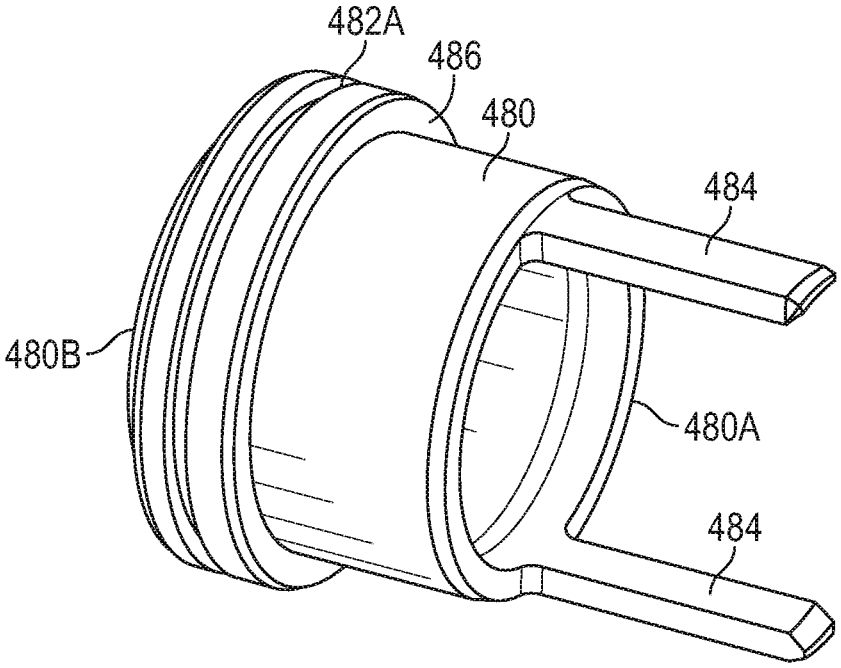
FIG. 18 is a perspective view of an embodiment of a locking piston of the bend adjustment assembly of FIG. 13 in accordance with principles disclosed herein.
Figure 19:
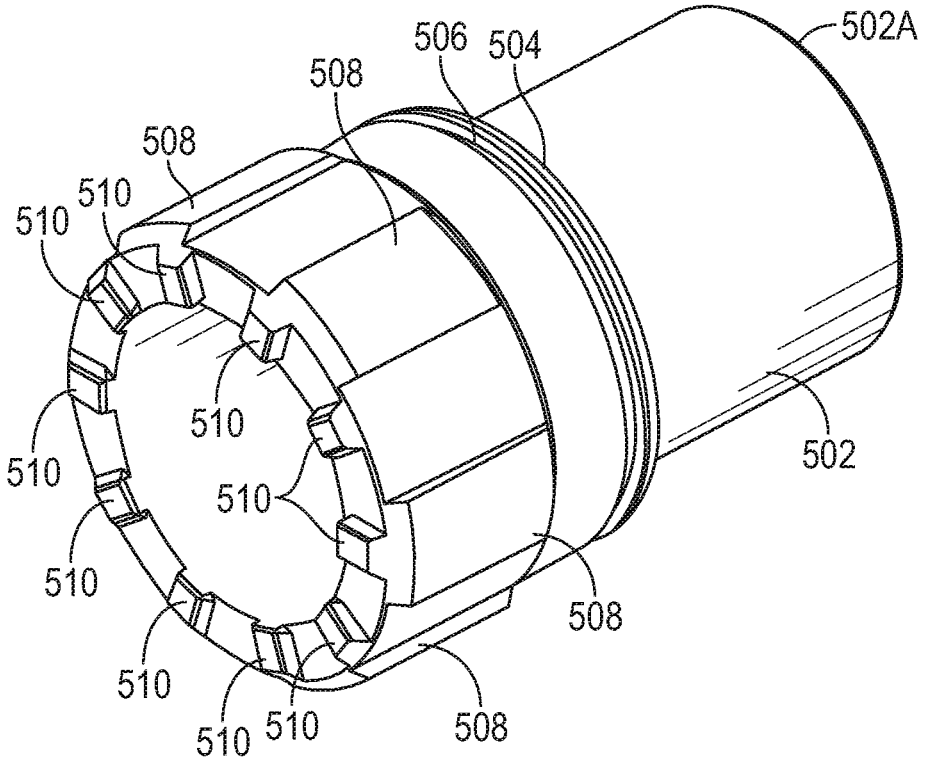
FIG. 19 is a perspective view of an embodiment of an actuator piston of the mud motor of FIG. 12 in accordance with principles disclosed herein.
Figure 20:
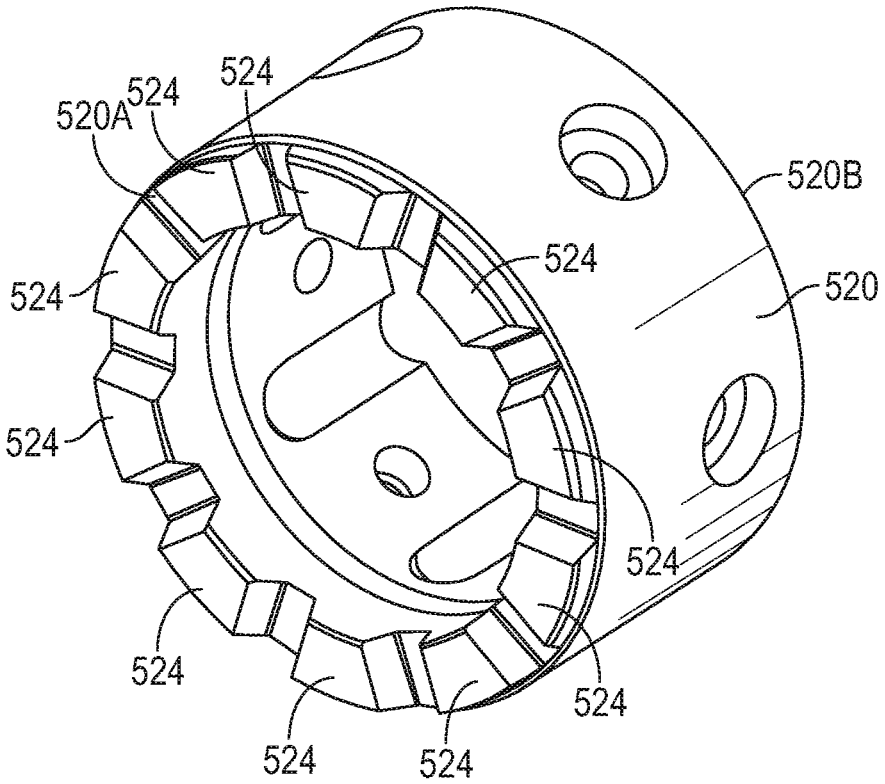
FIG. 20 is a perspective view of an embodiment of a torque transmitter of the mud motor of FIG. 12 in accordance with principles disclosed herein.

As shown particularly in FIGS. 13, 18, locking piston 480 of bend adjustment assembly 400 is generally tubular and has a first or upper end 480A, a second or lower end 480B, and a central bore or passage extending therebetween. Locking piston 480 includes a generally cylindrical outer surface comprising a pair of annular seals 482A, 482B disposed therein. In this embodiment, locking piston 480 includes a pair of circumferentially spaced keys 484 that extend axially from upper end 480A, where each key 484 extends through one of a pair of circumferentially spaced slots formed in the inner surface 422 of lower housing 420. In this arrangement, relative rotation between locking piston 480 and lower housing 420 is restricted while relative axial movement is permitted therebetween. As will be discussed further herein, each key 484 is receivable in either one of the short slots 476 or long slots 478 of lower adjustment mandrel 470 depending on the relative angular position between locking piston 480 and lower adjustment mandrel 470. In this embodiment, the outer surface of locking piston 480 includes an annular shoulder 486 positioned between annular seals 482A, 482B. In this embodiment, engagement between locking piston 480 and lower adjustment mandrel 470 serves to selectively restrict relative rotation between lower adjustment mandrel 470 and lower housing 420; however, in other embodiments, lower housing 420 includes one or more features (e.g., keys, etc.) receivable in slots 476, 478 to selectively restrict relative rotation between lower adjustment mandrel 470 and lower housing 420.

In this embodiment, the combination of sealing engagement between seal 482 of locking piston 480 and the inner surface 422 of lower housing 420, and seal 420S of housing 420 and the outer surface of locking piston 480, defines a lower axial end of locking chamber 495. Locking chamber 495 extends longitudinally from the lower axial end thereof to an upper axial end defined by the combination of sealing engagement between the outer seal 458A of compensating piston 456 and the inner seal 458B of piston 456. Particularly, lower adjustment mandrel 470 and upper adjustment mandrel 460 each include axially extending ports, including ports 468 formed in upper adjustment mandrel 460, similar in configuration to the ports 430 of lower housing 420 such that fluid communication is provided between the annular space directly adjacent shoulder 486 of locking piston 480 and the annular space directly adjacent a lower end of compensating piston 456. Locking chamber 495 is sealed such that drilling fluid flowing through mud motor 350 to drill bit 90 is not permitted to communicate with fluid disposed in locking chamber 495, where locking chamber 495 is filled with lubricant (e.g., an oil-based lubricant).

As shown particularly in FIGS. 14, 16, 19, and 20, locker assembly 500 of bend adjustment assembly 400 generally includes an actuator piston 502 and a torque transmitter or teeth ring 520. Actuator piston 502 is slidably disposed about bearing mandrel 152 and has a first or upper end 502A, a second or lower end 502B, and a central bore or passage extending therebetween. In this embodiment, actuator piston 502 has a generally cylindrical outer surface including an annular shoulder 504 and an annular seal 506 located axially between shoulder 504 and lower end 502B. The outer surface of actuator piston 502 includes a plurality of radially outwards extending and circumferentially spaced keys 508 (shown in FIG. 16) received in the slots 449 of actuator housing 440. In this arrangement, actuator piston 502 is permitted to slide axially relative actuator housing 440 while relative rotation between actuator housing 440 and actuator piston 502 is restricted. Additionally, in this embodiment, actuator piston 502 includes a plurality of circumferentially spaced locking teeth 510 extending axially from lower end 502B.

In this embodiment, seal 506 of actuator piston 502 sealingly engages the inner surface 442 of actuator housing 440 and an annular seal positioned on an inner surface of teeth ring 520 sealingly engages the outer surface of bearing mandrel 152. Additionally, the seal 448 of actuator housing 440 sealingly engages the outer surface of actuator piston 502 to form an annular, sealed compensating chamber 512 extending therebetween. Fluid pressure within compensating chamber 510 is compensated or equalized with the surrounding environment (e.g., borehole 16) via port 447 of actuator housing 440. Additionally, an annular biasing member 512 is disposed within compensating chamber 510 and applies a biasing force against shoulder 504 of actuator piston 502 in the axial direction of teeth ring 520. Teeth ring 520 of locker assembly 500 is generally tubular and comprises a first or upper end 520A, a second or lower end 520B, and a central bore or passage extending between ends 520A and 520B. Teeth ring 520 is coupled to bearing mandrel 152 via a plurality of circumferentially spaced splines or pins disposed radially therebetween. In this arrangement, relative axial and rotational movement between bearing mandrel 152 and teeth ring 520 is restricted. Additionally, in this embodiment, teeth ring 520 comprises a plurality of circumferentially spaced teeth 524 extending from upper end 520A. Teeth 524 of teeth ring 520 are configured to matingly engage or mesh with the teeth 510 of actuator piston 502 when biasing member 512 biases actuator piston 502 into contact with teeth ring 520, as will be discussed further herein.

As shown particularly in FIG. 14, in this embodiment, locker assembly 500 is both mechanically and hydraulically biased during operation of mud motor 350. Additionally, the driveline of mud motor 350 is independent of the operation of locker assembly 500 while drilling, thereby permitting 100% of the available torque provided by power section 50 to power drill bit 90 when locker assembly 500 is disengaged. The disengagement of locker assembly 500 may occur at high flowrates through mud motor 350, and thus, when higher hydraulic pressures are acting against actuator piston 502. Additionally, in some embodiments, locker assembly 500 may be used to rotate something parallel to bearing mandrel 152 instead of being used like a clutch to interrupt the main torque carrying driveline of mud motor 350. In this configuration, locker assembly 500 comprises a selective auxiliary drive that is simultaneously both mechanically and hydraulically biased. Further, this configuration of locker assembly 500 allows for various levels of torque to be applied as the hydraulic effect can be used to effectively reduce the preload force of biasing member 512 acting on mating teeth ring 520. This type of angled tooth clutch may be governed by the angle of the teeth (e.g., teeth 524 of teeth ring 520), the axial force applied to keep the teeth in contact, the friction of the teeth ramps, and the torque engaging the teeth to determine the slip torque that is required to have the teeth slide up and turn relative to each other.

In some embodiments, locker assembly 500 permits rotation in mud motor 350 to rotate rotor 50 and bearing mandrel 152 until bend adjustment assembly 400 has fully actuated, and then, subsequently, ratchet or slip while transferring relatively large amounts of torque to bearing housing 160. This reaction torque may be adjusted by increasing the hydraulic force or hydraulic pressure acting on actuator piston 502, which may be accomplished by increasing flowrate through mud motor 350. When additional torque is needed a lower flowrate or fluid pressure can be applied to locker assembly 500 to modulate the torque and thereby rotate bend adjustment assembly 400. The fluid pressure is transferred to actuator piston 502 by compensating piston 226. In some embodiments, the pressure drop across drill bit 90 may be used to increase the pressure acting on actuator piston 502 as flowrate through mud motor 350 is increased. Additionally, ratcheting of locker assembly 500 once bend adjustment assembly 400 reaches a fully bent position may provide a relatively high torque when teeth 524 are engaged and riding up the ramp and a very low torque when locker assembly 500 ratchets to the next tooth when the slipping torque value has been reached (locker assembly 500 catching again after it slips one tooth of teeth 524). This behavior of locker assembly 500 may provide a relatively good pressure signal indicator that bend adjustment assembly 400 has fully actuated and is ready to be locked.

As described above, bend adjustment assembly 400 includes the unbent position and a bent position 403 providing deflection angle θ. In this embodiment, central axis 115 of driveshaft housing 104 is parallel with, but laterally offset from central axis 215 of bearing mandrel 152 when bend adjustment assembly 400 is in the unbent position; however, in other embodiments, driveshaft housing 104 may comprise a fixed bent housing providing an angle between axes 115 and 215 when bend adjustment assembly 400 is in the unbent position. Locker assembly 500 is configured to control or facilitate the downhole or in-situ actuation or movement of bend adjustment assembly between the unbent position and the bent position 403. As will be described further herein, in this embodiment, bend adjustment assembly 400 is configured to shift from the unbent position to bent position 403 in response to rotation of lower housing 420 in a first direction relative to lower adjustment mandrel 470, and shift from bent position 403 to the unbent position in response to rotation of lower housing 420 in a second direction relative to lower adjustment mandrel 470 that is opposite the first direction.

Still referring to FIGS. 1, 12-20, in this embodiment, bend adjustment assembly 400 may be actuated the unbent position and bent position 403 via rotating offset housings 410 and 420 relative adjustment mandrels 460 and 470 in response to varying a flowrate of drilling fluid through mud motor 350 and/or varying the degree of rotation of drillstring 21 at the surface. Particularly, locking piston 480 includes a first or locked position restricting relative rotation between offset housings 410, 420, and adjustment mandrels 460, 470, and a second or unlocked position axially spaced from the locked position that permits relative rotation between housings 410, 420, and adjustment mandrels 460, 470. In the locked position of locking piston 480, keys 484 are received in either short slots 476 or long slots 478 of lower adjustment mandrel 470, thereby restricting relative rotation between locking piston 480, which is not permitted to rotate relative lower housing 420, and lower adjustment mandrel 470. In the unlocked position of locking piston 480, keys 484 of locking piston 480 are not received in either short slots 476 or long slots 478 of lower adjustment mandrel 470, and thus, rotation is permitted between locking piston 480 and lower adjustment mandrel 470. Additionally, in this embodiment, bearing housing 160, actuator housing 440, lower housing 420, and upper housing 410 are threadably connected to each other. Similarly, lower adjustment mandrel 470, upper adjustment mandrel 460, and driveshaft housing 104 are each threadably connected to each other in this embodiment. Thus, relative rotation between offset housings 410, 420, and adjustment mandrels 460, 470, results in relative rotation between bearing housing 160 and driveshaft housing 104.

As described above, offset bore 427 and offset engagement surface 423 of lower housing 420 are offset from central bore 429 and the central axis of housing 420 to form a lower offset angle, and offset engagement surface 465 of upper adjustment mandrel 460 is offset from the central axis of mandrel 460 to form an upper offset angle. Additionally, offset engagement surface 423 of lower housing 420 matingly engages the engagement surface 472 of lower adjustment mandrel 470 while the engagement surface 414 of housing extension 410 matingly engages the offset engagement surface 465 of upper adjustment mandrel 460. In this arrangement, the relative angular position between lower housing 420 and lower adjustment mandrel 470 determines the total offset angle (ranging from 0° to a maximum angle greater than 0°) between the central axes of lower housing 420 and driveshaft housing 104.

The minimum angle (0° in this embodiment) occurs when the upper and lower offsets are in-plane and cancel out, while the maximum angle occurs when the upper and lower offsets are in-plane and additive. Therefore, by adjusting the relative angular positions between offset housings 410, 420, and adjustment mandrels 460, 470, the deflection angle θ and bend 121 of bend adjustment assembly 400 may be adjusted or manipulated in-turn. The magnitude of bend 121 is controlled by the relative positioning of shoulders 428S and shoulders 475, which establish the extents of angular rotation in each direction. In this embodiment, lower housing 420 is provided with a fixed amount of spacing between shoulders 428S, while adjustment mandrel 470 can be configured with an optional amount of spacing between shoulders 475, allowing the motor to be set up with the desired bend setting options as dictated by a particular job simply by providing the appropriate configuration of lower adjustment mandrel 470.

Also as described above, locker assembly 500 is configured to control the actuation of bend adjustment assembly 400, and thereby, control the degree of bend 121. In this embodiment, locker assembly 500 is configured to selectively or controllably transfer torque from bearing mandrel 152 (supplied by rotor 50) to actuator housing 440 in response to changes in the flowrate of drilling fluid supplied to power section 40. Particularly, in this embodiment, to actuate bend adjustment assembly 400 from the unbent position to bent position 403, the pumping of drilling mud from surface pump 23 and the rotation of drillstring 21 by rotary system 24 is ceased. Particularly, the pumping of drilling mud from surface pump 23 is ceased for a predetermined first time period. In some embodiments, the first time period over which pumping is ceased from surface pump 23 comprises approximately 15-120 seconds; however, in other embodiments, the first time period may vary. With the flow of drilling fluid to power section 40 ceased during the first time period, fluid pressure applied to the lower end 480B of locking piston 480 (from drilling fluid in annulus 116) is reduced, while fluid pressure applied to the upper end 480A of piston 480 is maintained, where the fluid pressure applied to upper end 480A is from lubricant disposed in locking chamber 495 that is equalized with the fluid pressure in borehole 16 via ports 114 and locking piston 456. With the fluid pressure acting against lower end 480B of locking piston 480 reduced, the biasing force applied to the upper end 480A of piston 480 via biasing member 454 (the force being transmitted to upper end 480A via the fluid disposed in locking chamber 495) is sufficient to displace or actuate locking piston 480 from the locked position with keys 484 received in long slots 478 of lower adjustment mandrel 470, to the unlocked position with keys 484 free from long slots 478, thereby unlocking offset housings 410, 420, from adjustment mandrels 460, 470. In this manner, locking piston 480 comprises a first locked position with keys 484 receives in short slots 476 of lower adjustment mandrel 470 and a second locked position, which is axially spaced from the first locked position, with keys 484 receives in long slots 478 of lower adjustment mandrel 470.

In this embodiment, directly following the first time period, surface pump 23 resumes pumping drilling mud into drillstring 21 at a first flowrate that is reduced by a predetermined percentage from a maximum mud flowrate of well system 10, where the maximum mud flowrate of well system 10 is dependent on the application, including the size of drillstring 21 and BHA 30. For instance, the maximum mud flowrate of well system 10 may comprise the maximum mud flowrate that may be pumped through drillstring 21 and BHA 30 before components of drillstring 21 and/or BHA 30 are eroded or otherwise damaged by the mud flowing therethrough. In some embodiments, the first flowrate of drilling mud from surface pump 23 comprises approximately 1%-30% of the maximum mud flowrate of well system 10; however, in other embodiments, the first flowrate may vary. For instance, in some embodiments, the first flowrate may comprise zero or substantially zero fluid flow. In this embodiment, surface pump 23 continues to pump drilling mud into drillstring 21 at the first flowrate for a predetermined second time period while rotary system 24 remains inactive. In some embodiments, the second time period comprises approximately 15-120 seconds; however, in other embodiments, the second time period may vary.

During the second time period with drilling mud flowing through BHA 30 from drillstring 21 at the first flowrate, rotational torque is transmitted to bearing mandrel 152 via rotor 50 of power section 40 and driveshaft 106. Additionally, biasing member 512 applies a biasing force against shoulder 504 of actuator piston 502 to urge actuator piston 502 into contact with teeth ring 520, with teeth 510 of piston 502 in meshing engagement with the teeth 524 of teeth ring 520. In this arrangement, torque applied to bearing mandrel 152 is transmitted to actuator housing 440 via the meshing engagement between teeth 524 of teeth ring 520 (rotationally fixed to bearing mandrel 152) and teeth 510 of actuator piston 502 (rotationally fixed to actuator housing 440). Rotational torque applied to actuator housing 440 via locker assembly 500 is transmitted to offset housings 410, 420, which rotate (along with bearing housing 160) in a first rotational direction relative adjustment mandrels 460, 470. Particularly, extension 428 of lower housing 420 rotates through arcuate recess 474 of lower adjustment mandrel 470 until a shoulder 428S engages a corresponding shoulder 475 of recess 474, restricting further relative rotation between offset housings 410, 420, and adjustment mandrels 460, 470. Following the rotation of lower housing 420, bend adjustment assembly 400 is disposed in bent position 403 providing bend 121. Additionally, although during the actuation of bend adjustment assembly 400 drilling fluid flows through mud motor 350 at the first flowrate, the first flowrate is not sufficient to overcome the biasing force provided by biasing member 454 against locking piston 480 to thereby actuate locking piston 480 back into the locked position.

In this embodiment, directly following the second time period, with bend adjustment assembly 400 disposed in bent position 403, the flowrate of drilling mud from surface pump 23 is increased from the first flowrate to a second flowrate that is greater than the first flowrate. In some embodiments, the second flowrate of drilling mud from surface pump 23 comprises approximately 50%-100% of the maximum mud flowrate of well system 10; however, in other embodiments, the second flowrate may vary. Following the second time period with drilling mud flowing through BHA 30 from drillstring 21 at the second flowrate, the fluid pressure applied to the lower end 480B of locking piston 480 is sufficiently increased to overcome the biasing force applied against the upper end 480A of piston 480 via biasing member 454, actuating or displacing locking piston 480 from the unlocked position to the locked position with keys 484 received in short slots 476, thereby rotationally locking offset housings 410, 420, with adjustment mandrels 460, and 470.

Additionally, with drilling mud flowing through BHA 30 from drillstring 21 at the second flowrate, fluid pressure applied against the lower end 502B of actuator piston 502 from the drilling fluid (such as through leakage of the drilling fluid in the space disposed radially between the inner surface of actuator piston 502 and the outer surface of bearing mandrel 152) is increased, overcoming the biasing force applied against shoulder 504 by biasing member 512 and thereby disengaging actuator piston 502 from teeth ring 520. With actuator piston 502 disengaged from teeth ring 520, torque is no longer transmitted from bearing mandrel 152 to actuator housing 440. In some embodiments, as in borehole 16 is drilled with bend adjustment assembly 400 in bent position 403, additional pipe joints may need to be coupled to the upper end of drillstring 21, necessitating the stoppage of the pumping of drilling fluid to power section 40 from surface pump 23. In some embodiments, following such a stoppage, the steps described above for actuating bend adjustment assembly 400 into bent position 403 may be repeated to ensure that assembly 400 remains in bent position 403.

On occasion, it may be desirable to actuate bend adjustment assembly 400 from bent position 403 to the unbent position. In this embodiment, bend adjustment assembly 400 is actuated from bent position 403 to the unbent position by ceasing the pumping of drilling fluid from surface pump 23 for a predetermined third period of time. Either concurrent with the third time period or following the start of the third time period, rotary system 24 is activated to rotate drillstring 21 at a first or actuation rotational speed for a predetermined fourth period of time. In some embodiments, both the third time period and the fourth time period each comprise approximately 15-120 seconds; however, in other embodiments, the third time period and the fourth time period may vary. Additionally, in some embodiments, the rotational speed comprises approximately 1-30 revolutions per minute (RPM) of drillstring 21; however, in other embodiments, the actuation rotational speed may vary. During the fourth time period, with drillstring 21 rotating at the actuation rotational speed, reactive torque is applied to bearing housing 160 via physical engagement between an outer surface of bearing housing 160 and the sidewall 19 of borehole 16, thereby rotating bearing housing 160 and offset housings 410, 420, relative to adjustment mandrels 460, 470 in a second rotational direction opposite the first rotational direction described above. Rotation of lower housing 420 causes shoulder 428 to rotate through recess 474 of lower adjustment mandrel 470 until a shoulder 428S physically engages a corresponding shoulder 475 of recess 474, restricting further rotation of lower housing 420 in the second rotational direction.

In this embodiment, following the third and fourth time periods (the fourth time period ending either at the same time as the third time period or after the third time period has ended), with bend adjustment assembly 400 disposed in the unbent position, drilling mud is pumped through drillstring 21 from surface pump 23 at a third flowrate for a predetermined fifth period of time while drillstring 21 is rotated by rotary system 24 at the actuation rotational speed. In some embodiments, the fifth period of time comprises approximately 15-120 second and the third flowrate of drilling mud from surface pump 23 comprises approximately 30%-80% of the maximum mud flowrate of well system 10; however, in other embodiments, the firth period of time and the third flowrate may vary.

Following the fifth period of time, the flowrate of drilling mud from surface pump 23 is increased from the third flowrate to a flowrate near or at the maximum mud flowrate of well system 10 to thereby disengage locker assembly 500 and dispose locking piston 480 in the locked position. Once surface pump 23 is pumping drilling mud at the drilling or maximum mud flowrate of well system 10, rotation of drillstring 21 via rotary system 24 may be ceased or continued at the actuation rotational speed. With drilling mud being pumped into drillstring 21 at the third flowrate and the drillstring 21 being rotated at the actuation rotational speed, locker assembly 500 is disengaged and locking piston 480 is disposed in the locked position with keys 484 received in long slots 478 of lower adjustment mandrel 470.

With locker assembly 400 disengaged and locking piston 480 disposed in the locked position drilling of borehole 16 via BHA 30 may be continued with surface pump 23 pumping drilling mud into drillstring 21 at or near the maximum mud flowrate of well system 10. In other embodiments, instead of surface pump 23 at the third flowrate for a period of time following the third and fourth time periods, surface pump 23 may be operated immediately at 100% of the maximum mud flowrate of well system 10 to disengage locker assembly 500 and dispose locking piston 480 in the locked position. Once surface pump 23 is pumping drilling mud at the drilling or maximum mud flowrate of well system 10, rotation of drillstring 21 via rotary system 24 may be ceased or continued at the actuation rotational speed.

Referring to FIGS. 23-26, another embodiment of a downhole mud motor 650 for use in the BHA 30 of FIG. 1 is shown in FIGS. 23-26. Mud motor 650 generally includes driveshaft assembly 102 (not shown in FIGS. 23-26), actuator assembly 500 (similar to the configuration shown in FIGS. 12, 14, 21, and 22), bearing assembly 150 (not shown in FIGS. 23-26), and a bend adjustment assembly 652. Bend adjustment assembly 652 includes features in common with the bend adjustment assembly 400 shown in FIGS. 12-22, and shared features are labeled similarly.

Particularly, in the embodiment of FIGS. 23-26, bend adjustment assembly 652 is similar to bend adjustment assembly 400 except that bend adjustment assembly 652 includes a lower offset housing 660 and a lower adjustment mandrel 680. Lower offset housing 660 has a first or upper end 660A, a second or lower end (not shown in FIGS. 23-26), and a central bore or passage defined by a generally cylindrical inner surface extending between upper end 660A and the lower end of lower offset housing 660. In this embodiment, lower offset housing 660 of bend adjustment assembly 650 is similar to lower offset housing 420 of bend adjustment assembly 400 except that a locking shoulder 662, defined by a pair of axially extending shoulders 664, of lower offset housing 660 (similar in functionality to locking shoulder 428 of lower offset housing 420) includes a plurality of circumferentially spaced lugs or protrusions 667 positioned at upper end 660A.

Lower offset mandrel 680 has a first or upper end 680A, a second or lower end 680B, and a central bore or passage defined by a generally cylindrical inner surface extending between ends 680A, 680B. In this embodiment, lower offset mandrel 680 of bend adjustment assembly 650 is similar to lower offset mandrel 470 of bend adjustment assembly 400 except that the inner terminal end 474E of the arcuate recess 474 of lower offset mandrel 680 includes a plurality of circumferentially spaced lugs or protrusions 682 positioned at upper end 660A formed thereon and configured to matingly engage or interlock with the lugs 667 of lower offset housing 660. Lower adjustment mandrel 680 of bend adjustment assembly 652 includes a first or locked position (shown in FIG. 23) and a second or unlocked position which is axially spaced from the locked position.

In the locked position, lugs 682 of lower adjustment mandrel 680 interlock with lugs 667 of lower offset housing 660, locking bend adjustment assembly 652 in a configuration providing a first bend angle $\theta_1$. In the unlocked position of lower adjustment mandrel 680, lugs 682 of lower adjustment mandrel 680 are spaced from lugs 667 of lower offset housing 660 permitting bend adjustment assembly 652 to actuate from the first configuration providing the first bend angle $\theta_1$ and a second configuration providing a second bend angle $\theta_2$ that is different from the first bend angle $\theta_1$. In this embodiment, in the unlocked position of lower adjustment mandrel 680, lugs 682 of lower adjustment mandrel 680 are spaced from lugs 667 of lower offset housing 660 permitting bend adjustment assembly 652 to actuate from the unbent position to bent position 403 providing bend 121.

Bend adjustment assembly 652 additionally includes a selectable pin assembly 690 and a plurality of circumferentially spaced frangible members or shear pins 700 configured to lock lower adjustment mandrel 680 in the locked position until a predetermined fluid flow rate and/or fluid pressure through mud motor 650 is achieved. In this embodiment, the predetermined fluid flow rate is equal to or greater than the fluid flowrate required to disengage locker assembly 500 and dispose locking piston 480 in the locked position. In this embodiment, pin assembly 690 is received in a slot 684 formed in the inner surface of lower adjustment mandrel 680 and comprises an elongate member or pin 692 engaged by a biasing member 696. Pin 692 includes a notch or recess 694 which receives a tab 686 formed on the outer surface of the upper adjustment mandrel 460' of bend adjustment assembly 652 when lower adjustment mandrel 680 is in the locked position. Each shear pin 700 extends radially between an aperture formed in the inner surface of lower adjustment mandrel 680 and an aperture formed in the outer surface of upper adjustment mandrel 460'.

When lower adjustment mandrel 680 is in the locked position, pin 692 of selectable pin assembly 690 is in a first position with tab 686 received in notch 694 of pin 692. Upon reaching the predetermined fluid flow rate or pressure, shear pins 700 are sheared, permitting lower adjustment mandrel 680 to enter the unlocked position. Upon lower adjustment mandrel 680 entering the unlocked position, tab 686 of upper adjustment mandrel 460' is released from notch 694 of pin 692, permitting biasing member 696 to bias pin 692 into a second position that is laterally spaced from the first position of pin 692. In the second position, notch 694 of pin 692 is laterally misaligned with the tab 686 of upper adjustment mandrel 460', thereby preventing lower adjustment mandrel 680 from returning to the locked position in the event of fluid flow and/or pressure through mud motor 650 descending below the threshold fluid flow and/or pressure.

Lugs 682, 532, selectable pin assembly 690, and shear pins 700 collectively comprise a locking assembly 695 configured to permit an operator of mud motor 650 to selectably enable downhole adjustability of bend 121 at the surface. In other words, the operator may selectably reconfigure mud motor 650 from a fixed bend mud motor 650 to a downhole-adjustable mud motor 650 from the surface by controlling the flowrate of drilling fluid supplied to mud motor 650. Without the locking assembly 695 of mud motor 650, a startup procedure may be required every time fluid flow to the mud motor is ceased in order to hold a fixed bend position. For example, as in borehole 16, additional pipe joints may need to be coupled to the upper end of drillstring 21, necessitating the stoppage of the pumping of drilling fluid to power section 40 from surface pump 23. The need to perform a startup procedure following each fluid flow stoppage may increase the time required for drilling borehole 16, while also making the mud motor more difficult to operate.

In this embodiment, locking assembly 695 only permits lower adjustment mandrel 680 to actuate to the unlocked position in response to the pumping of fluid to mud motor 650 at a flowrate exceeding the drilling flowrate of well system 10. Particularly, when the operators of well system 10 are ready to deactivate locking assembly 695 and permit the actuation of bend adjustment assembly 652 between the unbent and bent positions, a high flowrate, exceeding the drilling flowrate of well system 10, is flowed through mud motor 650 with mud motor 650 lifted off-bottom of borehole 16. This high flowrate generates a pressure that exerts a force on the shear pins 700 above their shear strength. This force and pressure shear or frangibly break shear pins 700, allowing lower adjustment mandrel 680 to shift to the unlocked position. Once shifted into the unlocked position, lower adjustment mandrel 680 is prohibited from reentering the locked position by selectable pin assembly 690. With lower adjustment mandrel 680 disposed in the unlocked position, operators of well system 10 can actuate bend adjustment assembly 650 between the unbent and bent positions in a manner similar for actuating bend adjustment assembly 400 between the unbent and bent positions as described above.

Referring to FIGS. 1, 27-31, another embodiment of a downhole mud motor 750 for use in the BHA 30 of FIG. 1 is shown in FIGS. 27-31. Mud motor 750 generally includes driveshaft assembly 102, bearing assembly 150 (not shown in FIGS. 27-31), and a bend adjustment assembly 752. Bend adjustment assembly 752 includes features in common with the bend adjustment assembly 400 shown in FIGS. 12-22, and shared features are labeled similarly. Particularly, in the embodiment of FIGS. 27-31, bend adjustment assembly 752 is similar to bend adjustment assembly 400 except that bend adjustment assembly 752 further includes a fluid metering assembly 760 generally including an annular seal carrier 762 and an annular seal body 780, each disposed around the locking piston 480 of bend adjustment assembly 752.

Figure 31:
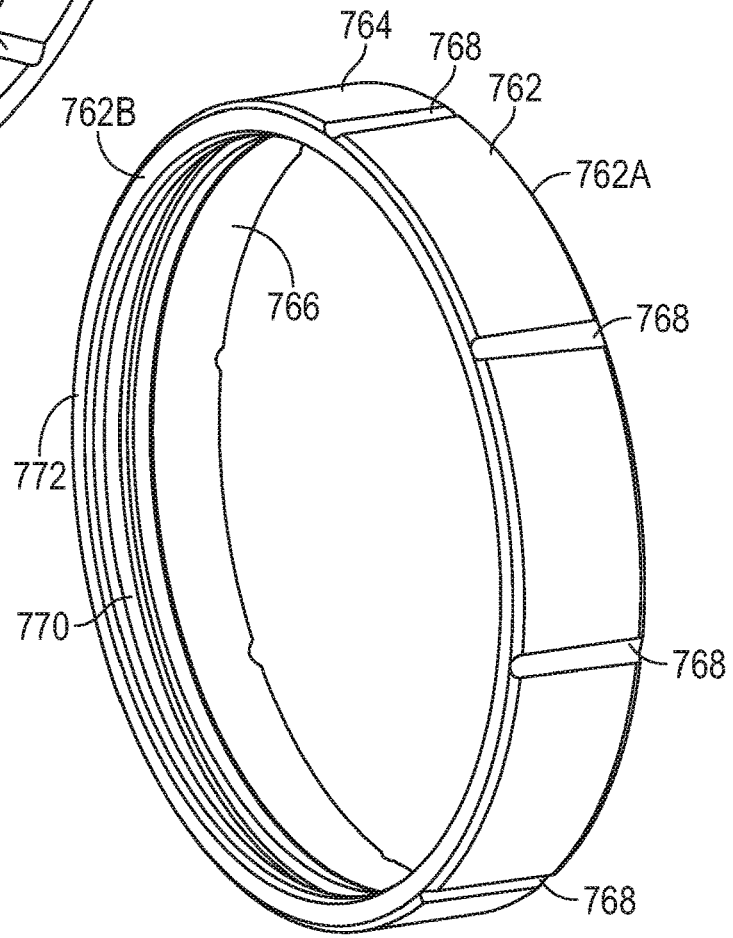
FIG. 31 is a perspective view of an embodiment of a seal carrier of the fluid metering assembly of FIGS. 28, 29 in accordance with principles disclosed herein.

As shown particularly in FIG. 31, seal carrier 762 has a first or upper end 762A, a second or lower end 762B opposite upper end 762A, a generally cylindrical outer surface 764 extending between ends 762A, 762B, and a generally cylindrical inner surface 766 extending between ends 762A, 762B. In this embodiment, outer surface 764 of seal carrier 762 includes a plurality of flow channels 768 extending between ends 762A, 762B, and the inner surface 766 receives an annular seal 770 configured to sealingly engage a detent or upset 758 (shown in FIG. 27) formed on the outer surface of locking piston 480. As shown particularly in FIG. 30, seal body 780 has a first or upper end 780A, a second or lower end 780B, a generally cylindrical outer surface 782 extending between ends 780A, 780B, and a generally cylindrical inner surface 784 extending between ends 780A, 780B. In this embodiment, the outer surface 782 of seal body 780 receives an annular seal 786 configured to sealingly engage the inner surface 422 of lower offset housing 420, and the inner surface 784 comprises a plurality of circumferentially spaced flow channels 788 extending between ends 780A, 780B. Additionally, the upper end 780A of seal body 780 defines a seal endface 790 configured to sealingly engage a seal endface 772 defined by the lower end 762B of seal carrier 762. Further, endface 790 of seal body 780 includes a plurality of metering channels 792 extending between the outer surface 782 and the inner surface 784.

Fluid metering assembly 760 is configured to retard, delay, or limit the actuation of locking piston 480 between the unlocked and locked positions in at least one axial direction. In the embodiment of FIGS. 27-31, fluid metering assembly 760 generally includes a seal carrier 762 and a seal body 780. The fluid metering assembly 760 limits or delays the movement of locking piston 480 through the detent 758 of locking piston 480 that sealing engages a seal carrier 762 when locking piston 780 is depressed via a change in flowrate or pressure across the downhole adjustable bend assembly 752. Particularly, in this embodiment, when locking piston 480 is actuated from the unlocked position to the locked position (indicated by arrow 775 in FIG. 28), seal carrier 762 is axially spaced from seal body 780, permitting fluid within locking chamber 495 to flow freely between the endfaces 772, 790 of seal carrier 762 and seal body 780, respectively.

However, in this embodiment, when locking piston 480 is actuated from the locked position to the unlocked position (indicated by arrow 777 in FIG. 29), endface 772 of seal carrier 762 sealingly engages the endface 790 of seal body 780. In this configuration, fluid within locking chamber 495 may only travel between endfaces 772, 790 of seal carrier 762 and seal body 780, respectively, via metering channels 792 of seal body 780, thereby restricting or metering fluid flow between seal carrier 762 and seal body 780. The flow restriction created between seal carrier 762 and seal body 780 in this configuration retards or delays the axial movement of locking piston 480 from the locked position to the unlocked position. The detent 758 on locking piston 480 can be positioned as to only restrict the movement of the locking piston 480 in returning from one or both unbent and bent positions of bend adjustment assembly 752. Metering channels 792 of seal body 780 are configured to allow for debris to be cleaned out of channels 792 when the locking piston 480 is stroked. Particularly, debris trapped within metering channels 792 are permitted to escape therefrom when locking piston 480 is actuated from the unlocked position to the locked position, which separates endfaces 772, 790 of seal carrier 762 and seal body 780, respectively.

Without the inclusion of fluid metering assembly 760 in bend adjustment assembly 750, a startup procedure may be required every time fluid flow to the mud motor is ceased in order to hold a fixed bend position. For example, as in borehole 16, additional pipe joints may need to be coupled to the upper end of drillstring 21, necessitating the stoppage of the pumping of drilling fluid to power section 40 from surface pump 23. The need to perform a startup procedure following each fluid flow stoppage may increase the time required for drilling borehole 16, while also making the mud motor more difficult to operate.

In this embodiment, fluid metering assembly 760 allows a timed return of the locking piston 480 that keeps the downhole adjustable bend assembly 752 in the last position it was shifted into for a set or predetermined period of time and for an unlimited number of actuation cycles. The time delay provided by the retarding of the motion of locking piston 480 from the locked position to the unlocked position allow operators of well system 10 to experience brief downtime or make connections of drillstring 21 while drilling so a startup procedure can be avoided at every pump off event.

To use the fluid metering assembly 760 flow is stopped from a drilling flowrate which then causes the seal carrier 762 to engage the seal body 780 with the seal carrier 762 sealingly engaging detent 758 of locking piston 480, thereby creating a fluid restriction within locking chamber 495. The restriction provided by fluid metering assembly 760 creates a pressure that sealingly engages the seal body 780 and seal carrier 762 and the volume change created by locking piston 480 travelling downwards to the unlocked position creates a flowrate across metering channels 792. Metering channels 792 limit the flowrate of this volume change created within locking chamber 495 and thus increase the time required for locking piston 480 to actuate from the locked position to the unlocked position. Once the predetermined time period has elapsed for actuating locking piston 480 to the unlocked position, bend adjustment assembly 752 may be actuated into either the unbent or bent positions as described above with respect to the operation of bend adjustment assembly 400.

Figure 32:
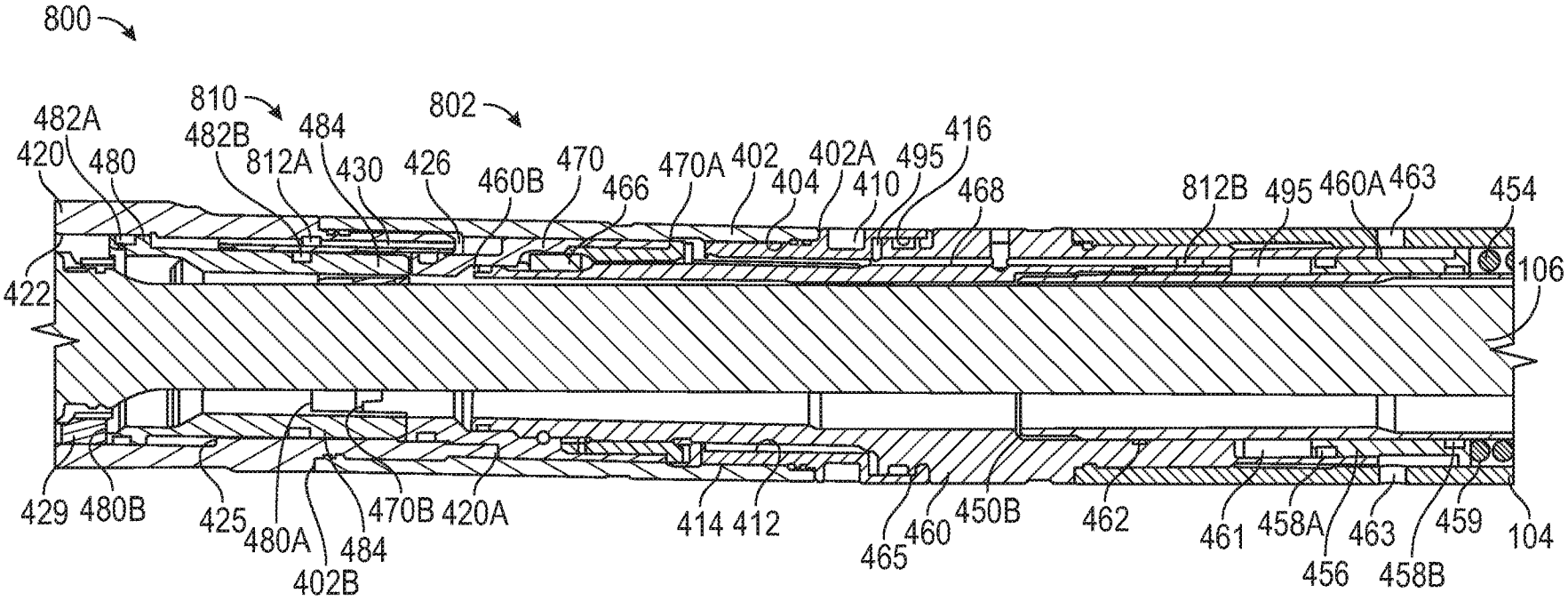
FIG. 32 is a side cross-sectional view of another embodiment of a downhole mud motor of the drilling system of FIG. 1 in accordance with principles disclosed herein.

Referring briefly to FIG. 32, another embodiment of a downhole mud motor 800 for use in the BHA 30 of FIG. 1 is shown in FIG. 32. Mud motor 800 is similar in configuration to mud motor 750 shown in FIGS. 27-31 and includes a bend adjustment assembly 802 having a flow metering assembly 810 for retarding the actuation of locking piston 480 from the locked position to the unlocked position. However, instead of utilizing a seal carrier and seal body, flow metering assembly 810 comprises a first flow metering device 812A positioned in port 430 of lower offset housing 420 and a second flow metering device 812B positioned in the port 468 of upper adjustment mandrel 460, respectively. Flow metering devices 812A, 812B each comprise a check valve and a flow restrictor configured to create a flow restriction for fluid in locking chamber 495 flowing in the axially downwards direction towards locking piston 480 when locking piston 480 is actuated from the locked position to the unlocked position.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole motor for directional drilling, comprising:

a driveshaft assembly including a driveshaft housing and a driveshaft rotatably disposed within the driveshaft housing; and a bearing assembly including a bearing housing and a bearing mandrel rotatably disposed within the bearing housing, wherein the bearing mandrel is configured to couple with a drill bit;

wherein the bearing assembly is configured to provide a first flowpath extending into a central passage of the bearing mandrel from an annulus formed between the bearing mandrel and the bearing housing and a second flowpath separate from the first flowpath, that extends into and through an annular bearing compartment extending radially between an outer surface of the bearing mandrel and an inner surface of the bearing housing to contact an annular first bearing of the bearing assembly that is disposed in the bearing compartment;

wherein a plurality of rotary seals are positioned radially between the bearing mandrel and the bearing housing to form a sealed chamber that is spaced from the first bearing of the bearing assembly and sealed from the bearing compartment, and wherein an annular second bearing of the bearing assembly is located in the sealed chamber.

2. The downhole motor of claim 1, wherein the annular first bearing comprises a ball bearing.

3. The downhole motor of claim 1, wherein the annular first bearing comprises a thrust bearing.

4. The downhole motor of claim 1, further comprising a flow restrictor positioned radially between the bearing mandrel and the bearing housing, wherein the flow restrictor is configured to restrict fluid flow through the second flowpath.

5. The downhole motor of claim 1, further comprising a bend assembly configured to permit selective adjustment of a bend formed between a central axis of the driveshaft housing and a central axis of the bearing housing.

6. The downhole motor of claim 1, wherein the second flowpath re-enters the first flowpath before passing through the drill bit.

7. The downhole motor of claim 1, wherein the sealed chamber comprises radial bushings.

8. The downhole motor of claim 1, wherein the sealed chamber comprises a hard-faced flow restrictor sleeve.

9. The downhole motor of claim 1, wherein the sealed chamber comprises polycrystalline diamond compact (PDC) radial bearings.

10. The downhole motor of claim 1, further comprising a flow control mechanism configured to regulate at least one of a fluid pressure and a fluid flowrate along the second flowpath.

11. The downhole motor of claim 10, wherein the flow control mechanism is mechanically or hydraulically biased to control the fluid pressure or the fluid flowrate through the second flowpath.

12. The downhole motor of claim 1, further comprising a port formed in the bearing mandrel comprising a nozzle configured to regulate the pressure or flowrate through the second flowpath.

13. The downhole motor of claim 1, further comprising:

a bend adjustment assembly including a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle; and an actuator assembly positioned in the sealed chamber configured to shift the bend adjustment assembly between the first position and the second position.

14. The downhole motor of claim 13, wherein the actuator assembly comprises:

an actuator housing through which the bearing mandrel extends;

an actuator piston coupled to the actuator housing, wherein the actuator piston comprises a first plurality of teeth; and a teeth ring coupled to the bearing mandrel and comprising a second plurality of teeth;

wherein the actuator piston is configured to matingly engage the first plurality of teeth with the second plurality of teeth of the teeth ring to transfer torque between the actuator housing and the bearing mandrel in response to the change in at least one of flowrate and pressure of a drilling fluid supplied to the downhole motor.

15. The downhole motor of claim 1, wherein:

the first flowpath extends into the central passage of the bearing mandrel from a first port of the bearing mandrel; and the second flowpath extends into the central passage of the bearing mandrel from a second port of the bearing mandrel that is axially spaced from the first port, and wherein the bearing is located axially between the first port and the second port.

16. A downhole motor for directional drilling, comprising:

a driveshaft housing;

a driveshaft rotatably disposed in the driveshaft housing;

a bearing mandrel coupled to the driveshaft;

a bend adjustment assembly including a first position that provides a first deflection angle between a longitudinal axis of the driveshaft housing and a longitudinal axis of the bearing mandrel, and a second position that provides a second deflection angle between the longitudinal axis of the driveshaft housing and the longitudinal axis of the bearing mandrel that is different from the first deflection angle;

an actuator assembly configured to shift the bend adjustment assembly between the first position and the second position in response to a change in at least one of flowrate of a drilling fluid supplied to the downhole motor, pressure of the drilling fluid supplied to the downhole motor, and relative rotation between the driveshaft housing and the bearing mandrel; and a locking assembly comprising a locked configuration configured to lock the bend adjustment assembly in at least one of the first position and the second position and an unlocked configuration configured to permit the actuator assembly to shift the bend adjustment assembly between the first position and the second position.

17. The downhole motor of claim 16, further comprising:

an offset housing comprising a first longitudinal axis and a first offset engagement surface concentric to a second longitudinal axis that is offset from the first longitudinal axis; and an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface;

wherein the locking assembly comprises a plurality of circumferentially spaced protrusions extending from the offset housing and a plurality of circumferentially spaced protrusions extending from the adjustment mandrel and configured to interlock with the protrusions of the offset housing when the locking assembly is in the locked configuration.

18. The downhole motor of claim 16, wherein the locking assembly further comprises a selector pin configured to retain the locking assembly in the unlocked configuration.

19. The downhole motor of claim 16, further comprising a shear pin configured to retain the locking assembly in the locked configuration.

20. The downhole motor of claim 16, wherein:

the bearing assembly is configured to provide a first flowpath extending into a central passage of the bearing mandrel from an annulus formed between the bearing mandrel and the bearing housing and a second flowpath separate from the first flowpath, that extends through a bearing of the bearing assembly that is disposed radially between the bearing mandrel and the bearing housing; and a plurality of rotary seals are positioned radially between the bearing mandrel and the bearing housing to form an sealed chamber that is spaced from the bearing of the bearing assembly.

21. A downhole motor for directional drilling, comprising:

a driveshaft housing;

a driveshaft rotatably disposed in the driveshaft housing;

a bearing mandrel coupled to the driveshaft;

a bend adjustment assembly including a first position that provides a first deflection angle between a longitudinal axis of the driveshaft housing and a longitudinal axis of the bearing mandrel;

wherein the bend adjustment assembly includes a second position that provides a second deflection angle between the longitudinal axis of the driveshaft housing and the longitudinal axis of the bearing mandrel that is different from the first deflection angle;

an actuator assembly configured to shift the bend adjustment assembly between the first position and the second position;

a locking piston comprising a locked position configured to prevent the actuator assembly from shifting the bend adjustment assembly between the first and second positions, and an unlocked position configured to permit the actuator assembly to shift the bend adjustment assembly between the first position and the second position;

a fluid metering assembly configured to restrict fluid flow to delay the actuation of the locking piston from the locked position to the unlocked position.

22. The downhole motor of claim 21, wherein:

the locking piston is configured to actuate from the locked position to the unlocked position in response to fluid flow through a locking chamber of the bend adjustment assembly; and the fluid metering assembly is configured to restrict fluid flow through the locking chamber.

23. The downhole motor of claim 21, wherein the actuator assembly configured to shift the bend adjustment assembly between the first position and the second position in response to a change in at least one of flowrate of a drilling fluid supplied to the downhole motor, pressure of the drilling fluid supplied to the downhole motor, and relative rotation between the driveshaft housing and the bearing mandrel.

24. The downhole motor of claim 21, further comprising:

an offset housing comprising a first longitudinal axis and a first offset engagement surface concentric to a second longitudinal axis that is offset from the first longitudinal axis; and an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface; and wherein the locked position of the locking piston restricts relative rotation between the offset housing and the adjustment mandrel, and the unlocked position, axially spaced from the locked position, of the locking piston permits relative rotation between the offset housing and the adjustment mandrel.

25. The downhole motor of claim 21, wherein the fluid metering assembly comprises an annular seal carrier and an annular seal body positioned around the locking piston.

26. The downhole motor of claim 25, wherein an endface of the seal carrier is configured to sealingly engage an endface of the seal body when the locking piston actuates from the locked position to the unlocked position.

27. The downhole motor of claim 25, wherein the endface of the seal carrier comprises a metering slot.

28. The downhole motor of claim 25, further comprising:

an offset housing comprising a first longitudinal axis and a first offset engagement surface concentric to a second longitudinal axis that is offset from the first longitudinal axis;

wherein the fluid metering device comprises at least one of a fluid restrictor and a check valve positioned in a passage extending through the offset housing.

29. The downhole motor of claim 21, wherein:

the bearing assembly is configured to provide a first flowpath extending into a central passage of the bearing mandrel from an annulus formed between the bearing mandrel and the bearing housing and a second flowpath separate from the first flowpath, that extends through a bearing of the bearing assembly that is disposed radially between the bearing mandrel and the bearing housing; and a plurality of rotary seals are positioned radially between the bearing mandrel and the bearing housing to form an sealed chamber that is spaced from the bearing of the bearing assembly.

30. The downhole motor of claim 21, wherein:

the bend adjustment assembly comprises an offset housing coupled to the driveshaft housing; and the locking piston is slidably disposed within the offset housing, and the fluid metering device is positioned radially between the locking piston and the offset housing.

* * * * *